United States Patent [19]

Nagai et al.

[11] Patent Number: 4,819,427

[45] Date of Patent: Apr. 11, 1989

[54] DOUBLE AIR-FUEL RATIO SENSOR SYSTEM HAVING IMPROVED EXHAUST EMISSION CHARACTERISTICS

[75] Inventors: Toshinari Nagai, Ann Arbor, Mich.; Takatoshi Masui, Mishima; Toshiyasu Katsuno, Susono, both of Japan

[73] Assignee: Toyota Jidosha Kabushiki Kaisha, Aichi, Japan

[21] Appl. No.: 166,049

[22] Filed: Mar. 9, 1988

Related U.S. Application Data

[62] Division of Ser. No. 943,797, Dec. 19, 1986, Pat. No. 4,747,265.

[30] Foreign Application Priority Data

Dec. 23, 1985 [JP] Japan ..... 60-287783
Dec. 28, 1985 [JP] Japan ..... 60-293477

[51] Int. Cl.[4] ..... F01N 3/20; F02D 41/22

[52] U.S. Cl. ..... 60/274; 60/276; 60/285; 123/479; 123/489

[58] Field of Search ..... 123/479, 440, 489, 589; 60/274, 276, 285; 364/431.05

[56] References Cited

U.S. PATENT DOCUMENTS

| | | | |
|---|---|---|---|
| 3,939,654 | 2/1976 | Creps | 60/276 |
| 4,027,477 | 6/1977 | Storey | 60/276 |
| 4,130,095 | 12/1978 | Bowler et al. | 123/440 |
| 4,235,204 | 11/1980 | Rice | 123/440 |
| 4,244,340 | 1/1981 | Herth et al. | 123/489 |
| 4,251,989 | 2/1981 | Norimatsu et al. | 123/489 |
| 4,475,517 | 10/1984 | Kobayashi et al. | 123/489 |
| 4,539,958 | 9/1985 | Ito et al. | 123/440 |
| 4,561,400 | 12/1985 | Hattori | 123/478 |
| 4,571,683 | 2/1986 | Kobayashi et al. | 364/431.05 |
| 4,707,985 | 11/1987 | Nagai et al. | 123/489 |

FOREIGN PATENT DOCUMENTS

| | | |
|---|---|---|
| 52-102934 | 8/1977 | Japan . |
| 53-103796 | 9/1978 | Japan . |
| 55-37562 | 3/1980 | Japan . |
| 57-32772 | 7/1982 | Japan . |
| 57-32773 | 7/1982 | Japan . |
| 57-32774 | 7/1982 | Japan . |
| 58-27848 | 2/1983 | Japan . |
| 58-48755 | 3/1983 | Japan . |
| 58-48756 | 3/1983 | Japan . |
| 58-53661 | 3/1983 | Japan . |
| 58-72647 | 4/1983 | Japan . |
| 58-72646 | 4/1983 | Japan . |
| 58-135343 | 8/1983 | Japan . |
| 58-152147 | 9/1983 | Japan . |
| 58-150039 | 9/1983 | Japan . |
| 58-150038 | 9/1983 | Japan . |
| 59-32644 | 2/1984 | Japan . |
| 59-206638 | 11/1984 | Japan . |
| 60-1340 | 1/1985 | Japan . |
| 60-26138 | 2/1985 | Japan . |
| 60-53635 | 3/1985 | Japan . |
| 61-34330 | 2/1986 | Japan . |
| 61-53436 | 3/1986 | Japan . |

*Primary Examiner*—Andrew M. Dolinar
*Attorney, Agent, or Firm*—Parkhurst, Oliff & Berridge

[57] ABSTRACT

In a double air-fuel sensor system including two air-fuel ratio sensors upstream and downstream of a catalyst converter provided in an exhaust gas passage, an actual air-fuel ratio is adjusted in accordance with the outputs of the upstream-side and downstream-side air-fuel ratio sensors. Also, when the output of the upstream-side air-fuel ratio sensor is in an abnormal state, an alarm is generated.

20 Claims, 22 Drawing Sheets

| Fig. 3A | Fig. 3B | Fig. 3C |
|---|---|---|

LEAN
RICH
A/F1

TDR1
CDLY1
0
t1
t2
t3
t4
t5
t6
t7
t8
TDL1
A/F1'
(F1)

TDR1
LEAN
RICH
(-TDL1)
TD R1

RSL
KIR
FAF1
RSR
KIL

| Fig. 5A | Fig. 5B | Fig. 5C |
|---|---|---|

V
1
0
V1
VR1
RICH
LEAN
TDR1
(-TDL1)
F1
KIR
RSL
FAF1
RSR
KIL
V
1
0
V2
VR2
LEAN
RICH
(-TDL2)
TDR2
F2
KI2
RS2
FAF2
RS2
KI2
RS2

| Fig. 9A | Fig. 9B |
|---|---|

V
1
0
V1
VR1

RICH
LEAN

TDR1
(-TDL1)
F1

KIR
RSL
FAF1
RSR
KIL

V
1
0
V2
VR2

LEAN
RICH (-TDL2)
TDR2
F2

MAX
RSR
MIN

MAX
RSL
MIN

LEAN
RICH
A/F1

TDL1
CDLY1
0
t1 t2 t3 t4 t5 t6 t7 t8
TDR1

(-TDR1)
TDL1
(-TDR1)
A/F1'
(F1)
LEAN
RICH

KIR
KIL
FAF1
RSL
RSR

DOUBLE AIR-FUEL RATIO SENSOR SYSTEM HAVING IMPROVED EXHAUST EMISSION CHARACTERISTICS

This is a Division of application Ser. No. 943,797 filed Dec. 19, 1986, now U.S. Pat. No. 4,747,265.

BACKGROUND OF THE INVENTION (1) Field of the Invention

The present invention relates to a method and apparatus for feedback control of an air-fuel ratio in an internal combustion engine having two air-fuel ratio sensors upstream and downstream of a catalyst converter disposed within an exhaust gas passage.

(2) Description of the Related Art

Generally, in a feedback control of the air-fuel ratio sensor ($O_2$ sensor) system, a base fuel amount TAUP is calculated in accordance with the detected intake air amount and detected engine speed, and the base fuel amount TAUP is corrected by an air-fuel ratio correction coefficient FAF which is calculated in accordance with the output of an air-fuel ratio sensor (for example, an $O_2$ sensor) for detecting the concentration of a specific component such as the oxygen component in the exhaust gas. Thus, an actual fuel amount is controlled in accordance with the corrected fuel amount. The above-mentioned process is repeated so that the air-fuel ratio of the engine is brought close to a stoichiometric air-fuel ratio.

According to this feedback control, the center of the controlled air-fuel ratio can be within a very small range of air-fuel ratios around the stoichiometric ratio required for three-way reducing and oxidizing catalysts (catalyst converter) which can remove three pollutants CO, HC, and $NO_X$ simultaneously from the exhaust gas.

In the above-mentioned $O_2$ sensor system where the $O_2$ sensor is disposed at a location near the concentration portion of an exhaust manifold, i.e., upstream of the catalyst converter, the accuracy of the controlled air-fuel ratio is affected by individual differences in the characteristics of the parts of the engine, such as the $O_2$ sensor, the fuel injection valves, the exhaust gas recirculation (EGR) valve, the valve lifters, individual changes due to the aging of these parts, environmental changes, and the like. That is, if the characteristics of the $O_2$ sensor fluctuate, or if the uniformity of the exhaust gas fluctuates, the accuracy of the air-fuel ratio feedback correction amount FAF is also fluctuated, thereby causing fluctuations in the controlled air-fuel ratio.

To compensate for the fluctuation of the controlled air-fuel ratio, double $O_2$ sensor systems have been suggested (see: U.S. Pat. Nos. 3,939,654, 4,027,477, 4,130,095, 4,235,204). In a double $O_2$ sensor system, another $O_2$ sensor is provided downstream of the catalyst converter, and thus an air-fuel ratio control operation is carried out by the downstream-side $O_2$ sensor is addition to an air-fuel ratio control operation carried out by the upstream-side $O_2$ sensor. In the double $O_2$ sensor system, although the downstreamside $O_2$ sensor has lower response speed characteristics when compared with the upstream-side $O_2$ sensor, the downstream-side $O_2$ sensor has an advantage in that the output fluctuation characteristics are small when compared with those of the upstream-side $O_2$ sensor, for the following reasons:

(1) On the downstream side of the catalyst converter, the temperature of the exhaust gas is low, so that the downstream-side $O_2$ sensor is not affected by a high temperature exhaust gas.

(2) On the downstream side of the catalyst converter, although various kinds of pollutants are trapped in the catalyst converter, these pollutants have little affect on the downstream side $O_2$ sensor.

(3) On the downstream side of the catalyst converter, the exhaust gas is mixed so that the concentration of oxygen in the exhaust gas is approximately in an equilibrium state.

Therefore, according to the double $O_2$ sensor system, the fluctuation of the output of the upstream-side $O_2$ sensor is compensated for by a feedback control using the output of the downstream-side $O_2$ sensor. Actually, as illustrated in FIG. 1, in the worst case, the deterioration of the output characteristics of the $O_2$ sensor in a single $O_2$ sensor system directly effects a deterioration in the emission characteristics. On the other hand, in a double $O_2$ sensor system, even when the output characteristics of the upstream-side $O_2$ sensor are deteriorated, the emission characteristics are not deteriorated. That is, in a double $O_2$ sensor system, even if only the output characteristics of the downstream-side $O_2$ are stable, good emission characteristics are still obtained.

In the above-mentioned double $O_2$ sensor system, however, an abnormal state, i.e., a deterioration state of the upstream-side $O_2$ sensor is detected by determining whether or not the output of the upstreamside $O_2$ sensor is reversed for a long time period, such as several seconds, even after all of the other air-fuel ratio feedback control conditions by the upstream-side $O_2$ sensor are satisfied. In this case, although it is easy to detect an abnormal state or a deterioration state of the upstream-side $O_2$ sensor due to cracking, wire breakage, or failure, it is often difficult to detect other abnormal states or deterioration states of the upstream-side $O_2$ sensor because the output of the upstream-side $O_2$ sensor is inclined to the rich side or to the lean side, so that compensation of the exhaust gas is impossible. On the other hand, usually, an abnormal state of the fuel injection valves is detected by detecting a fluctuation in the fuel pressure, but in this case also, it is difficult to detect an abnormal state of the fuel injection valves because the injection characteristics thereof are so changed that compensation of the exhaust gas is impossible. That is, if the controlled air-fuel ratio is inclined to the rich side or to the lean side due to the abnormal state or deterioration state of the upstream-side $O_2$ sensor or the fuel injection valves, although the air-fuel ratio feedback control by the downstream-side $O_2$ sensor is carried out to compensate for the inclination of the controlled air-fuel ratio, this compensation is incomplete. Also, in this case, when the upstream-side $O_2$ sensor or the fuel injection valves resume a normal state, the exhaust emission characteristics are affected by the previous air-fuel ratio feedback control by the downstream-side $O_2$ sensor.

SUMMARY OF THE INVENTION

It is an object of the present invention to provide a double air-fuel ratio sensor system in an internal combustion engine which can detect an abnormal state or deterioration state of the upstream-side air-fuel ratio sensor and the fuel injection valves, in which the compensation of the exhaust emission characteristics is impossible.

It is another object of the present invention to reduce the exhaust gas emissions after the upstream-side air-fuel ratio sensor or the fuel injection valves resume a normal state.

According to the present invention, in a double air-fuel sensor system including two air-fuel ratio sensors upstream and downstream of a catalyst converter provided in an exhaust gas passage, an actual air-fuel ratio is adjusted in accordance with the outputs of the upstream-side and downstream-side air-fuel ratio sensors. Also, when the output of the upstream-side air-fuel ratio sensor is in an abnormal state, an alarm is generated. That is, an abnormal state (or deterioration state) of the upstream-side air-fuel ratio sensor or an abnormal state of the fuel injection valves is detected by the output of the upstream-side air-fuel ratio sensor. As a result, the driver is informed of this adverse condition, and thus can exchange the deteriorated component such as an air-fuel ratio sensor or a fuel injection valve with a new one, thereby avoiding a deterioration of the exhaust gas characteristics.

Further, according to the present invention, when such an alarm is generated, the air-fuel ratio feedback control by the downstream-side air-fuel ratio sensor is prohibited. As a result, when the output of the upstream-side air-fuel ratio sensor resumes the normal state, the controlled air-fuel ratio promptly reaches an optimum value, thereby also avoiding a deterioration of the controlled air-fuel ratio.

BRIEF DESCRIPTION OF THE DRAWINGS

The present invention will be more clearly understood from the description as set forth below with reference to the accompanying drawings, wherein.

DESCRIPTION OF THE PREFERRED EMBODIMENTS

Figure 1:
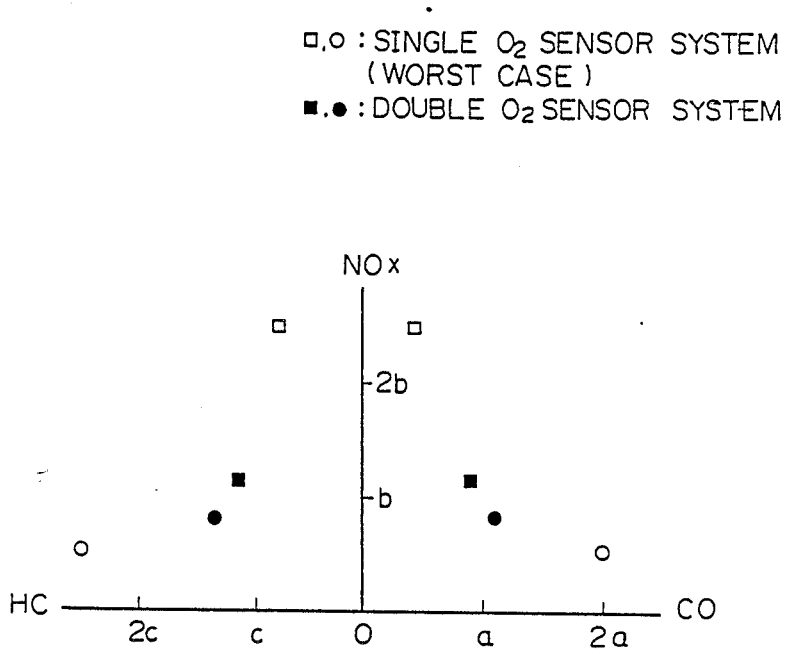
FIG. 1 is a graph showing the emission characteristics of a single $O_2$ sensor system and a double $O_2$ sensor system.
Figure 2:
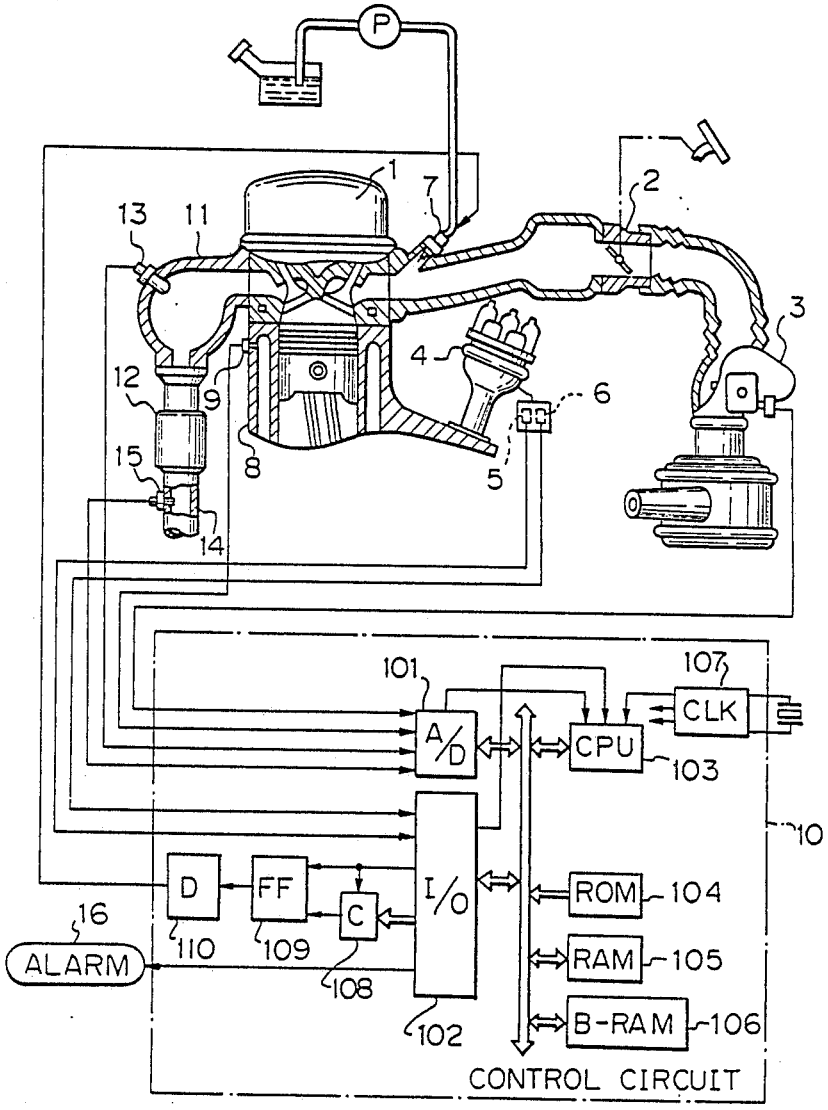
FIG. 2 is a schematic view of an internal combustion end according to the present invention.

In FIG. 2, which illustrates an internal combustion engine according to the present invention, reference numeral 1 designates a four-cycle spark ignition engine disposed in an automotive vehicle. Provided in an air-intake passage 2 of the engine 1 is a potentiometer-type airflow meter 3 for detecting the amount of air taken into the engine 1 to generate an analog voltage signal in proportion to the amount of air flowing therethrough. The signal of the airflow meter 3 is transmitted to a multiplexer-incorporating analog-to-digital (A/D) converter 101 of a control circuit 10.

Disposed in a distributor 4 are crank angle sensors 5 and 6 for detecting the angle of the crankshaft (not shown) of the engine 1.

In this case, the crank-angle sensor 5 generates a pulse signal at every 720° crank angle (CA) while the crank-angle sensor 6 generates a pulse signal at every 30° CA. The pulse signals of the crank angle sensors 5 and 6 are supplied to an input/output (I/O) interface 102 of the control circuit 10. In addition, the pulse signal of the crank angle sensor 6 is then supplied to an interruption terminal of a central processing unit (CPU) 103.

Additionally provided in the air-intake passage 2 is a fuel injection valve 7 for supplying pressurized fuel from the fuel system to the air-intake port of the cylinder of the engine 1. In this case, other fuel injection valves are also provided for other cylinders, but are not shown in FIG. 2.

Disposed in a cylinder block 8 of the engine 1 is a coolant temperature sensor 9 for detecting the temperature of the coolant. The coolant temperature sensor 9 generates an analog voltage signal in response to the temperature THW of the coolant and transmits it to the A/D converter 101 of the control circuit 10.

Provided in an exhaust system on the downstream-side of an exhaust manifold 11 is a three-way reducing and oxidizing catalyst converter 12 which removes three pollutants CO, HC, and $NO_X$ simultaneously from the exhaust gas.

Provided on the concentration portion of the exhaust manifold 11, i.e., upstream of the catalyst converter 12, is a first $O_2$ sensor 13 for detecting the concentration of oxygen composition in the exhaust gas. Further, provided in an exhaust pipe 14 downstream of the catalyst converter 12 is a second $O_2$ sensor 15 for detecting the concentration of oxygen composition in the exhaust gas. The $O_2$ sensors 13 and 15 generate output voltage signals and transmit them to the A/D converter 101 of the control circuit 10.

Reference 16 designates an alarm for indicating whether or not the output of the upstream-side $O_2$ sensor 13 is in an abnormal state.

The control circuit 10, which may be constructed by a microcomputer, further comprises a central processing unit (CPU) 103, a read-only memory (ROM) 104 for storing a main routine, interrupt routines such as a fuel injection routine, an ignition timing routine, tables (maps), constants, etc., a random access memory 105 (RAM) for storing temporary data, a backup RAM 106, an interface 102 of the control circuit 10.

The control circuit 10, which may be constructed by a microcomputer, further comprises a central processing unit (CPU) 103, a read-only memory (ROM) 104 for storing a main routine and interrupt routines such as a fuel injection routine, an ignition timing routine, tables (maps), constants, etc., a random access memory 105 (RAM) for storing temporary data, a backup RAM 106, a clock generator 107 for generating various clock signals, a down counter 108, a flip-flop 109, a driver circuit 110, and the like.

Note that the battery (not shown) is connected directly to the backup RAM 106 and, therefore, the content thereof is never erased even when the ignition switch (not shown) is turned off.

The down counter 108, the flip-flop 109, and the driver circuit 110 are used for controlling the fuel injection valve 7. That is, when a fuel injection amount TAU is calculated in a TAU routine, which will be later explained, the amount TAU is preset in the down counter 108, and simultaneously, the flip-flop 109 is set. As a result, the driver circuit 110 initiates the activation of the fuel injection valve 7. On the other hand, the down counter 108 counts up the clock signal from the clock generator 107, and finally generates a logic "1" signal from the carry-out terminal of the down counter 108, to reset the flip-flop 109, so that the driver circuit 110 stops the activation of the fuel injection valve 7. Thus, the amount of fuel corresponding to the fuel injection amount TAU is injected into the fuel injection valve 7.

Interruptions occur at the CPU 103 when the A/D converter 101 completes an A/D conversion and generates an interrupt signal; when the crank angle sensor 6 generates a pulse signal; and when the clock generator 107 generates a special clock signal.

The intake air amount data Q of the airflow meter 3 and the coolant temperature data THW of the coolant sensor 9 are fetched by an A/D conversion routine(s) executed at every predetermined time period and are then stored in the RAM 105. That is, the data Q and THW in the RAM 105 are renewed at every predetermined time period. The engine speed Ne is calculated by an interrupt routine executed at 30° CA, i.e., at every pulse signal of the crank angle sensor 6, and is then stored in the RAM 105.

The operation of the control circuit 10 of FIG. 2 will be now explained.

Figures 3, 3A:
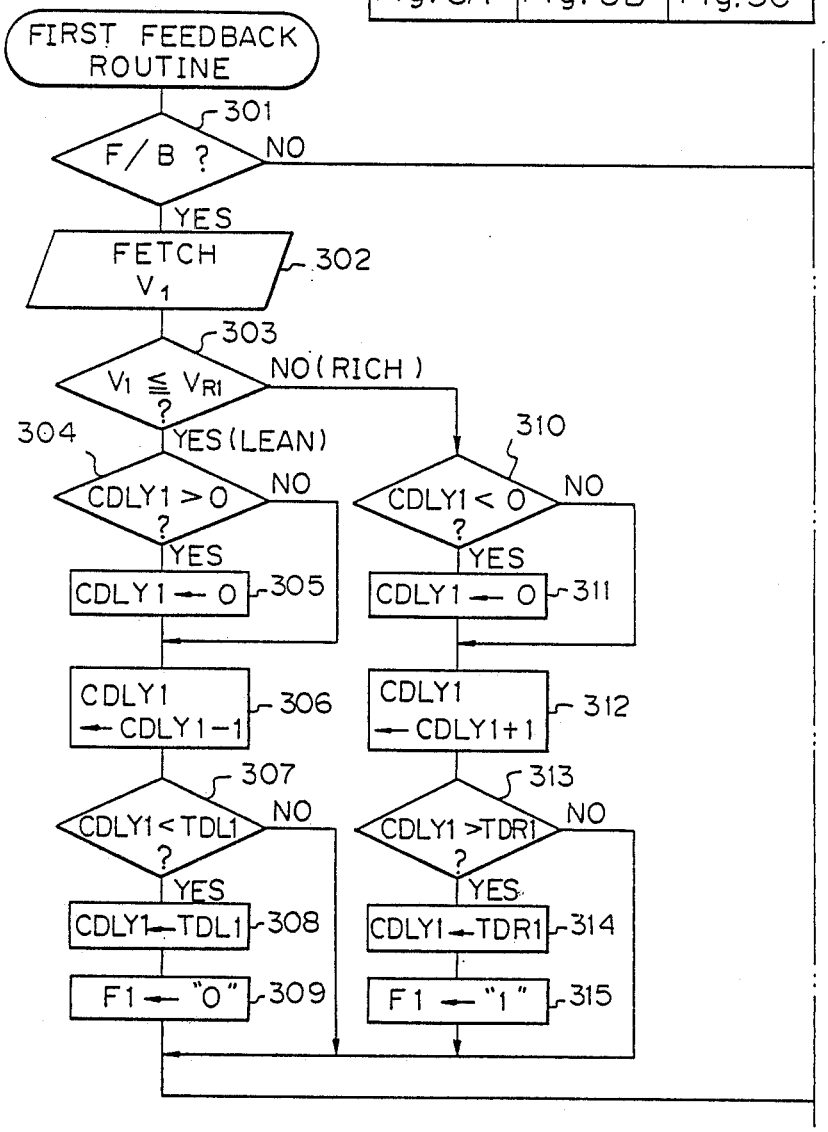
FIGS. 3, 3A–3C, 5, 5A–5C, 6, 9, 9A, 9B, 10, 13, 14, 15, 16, and 18 are flow charts showing the operation of the control circuit of FIG. 2.
Figure 3B:
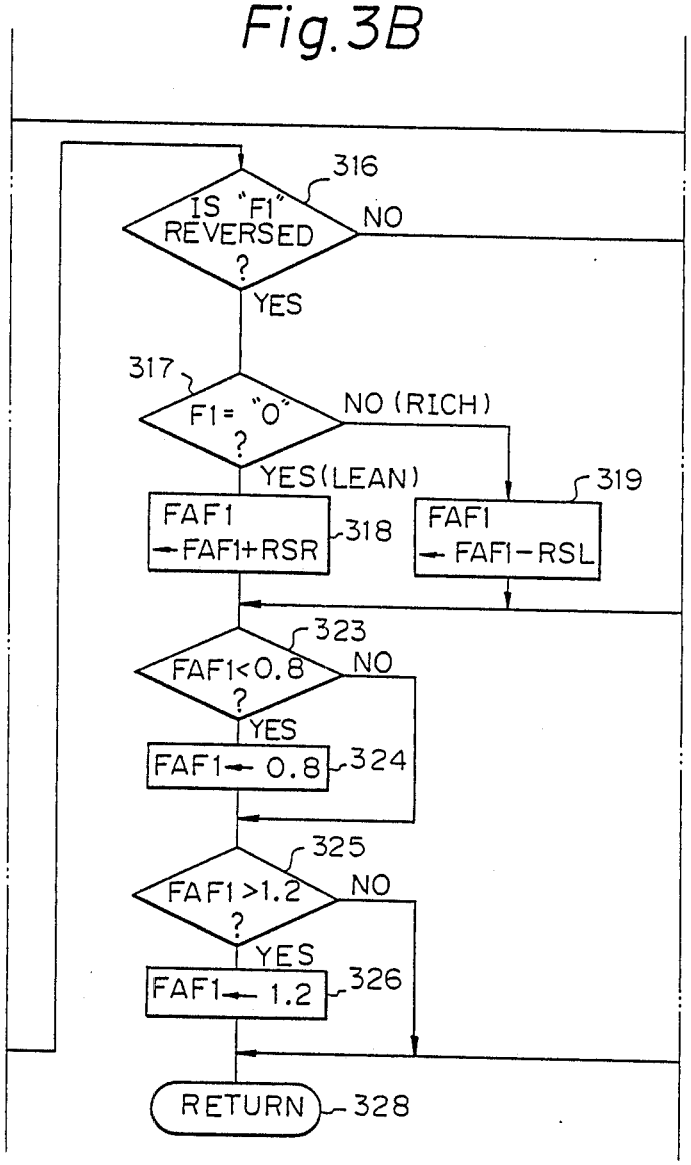
Figure 3C:
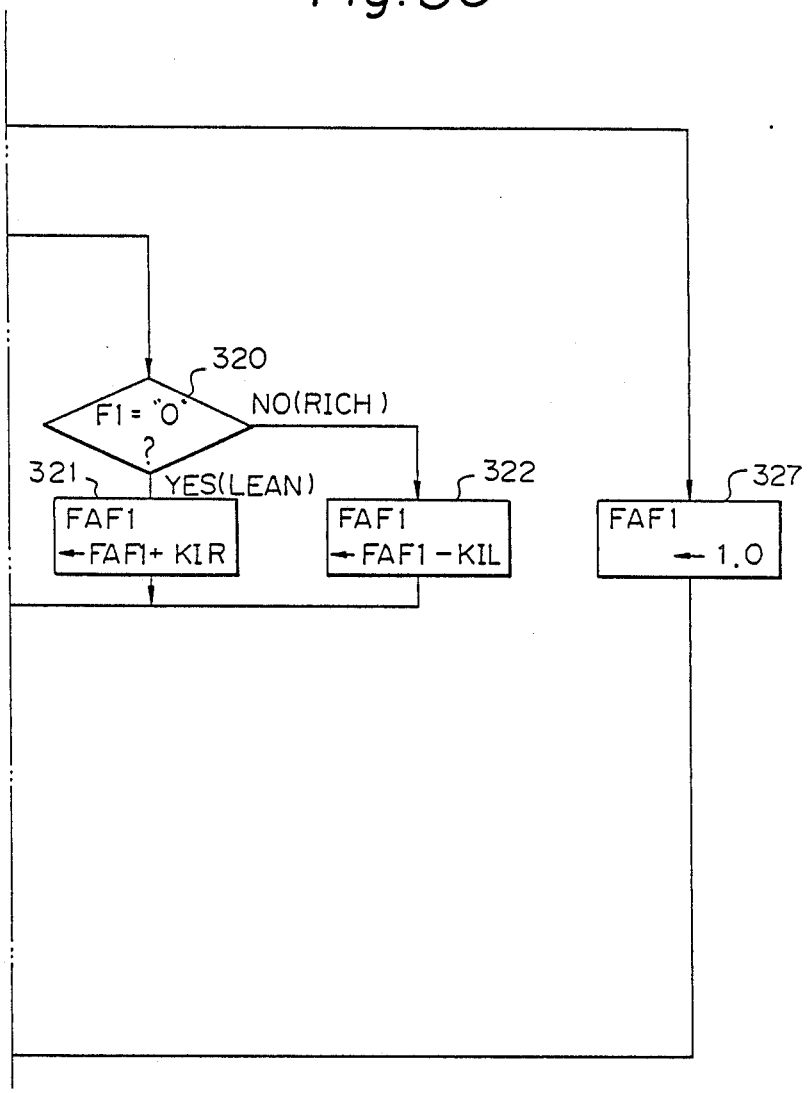

FIG. 3 is a routine for calculating a first air-fuel ratio feedback correction amount FAF1 in accordance with output of the upstream-side $O_2$ sensor 13 executed at every predetermined time period such as 4 ms.

At step 301, it is determined whether or not all of the feedback control (closed-loop control) conditions by the upstream-side $O_2$ sensor 13 are satisfied. The feedback control conditions are as follows:

(i) the engine is not in a starting state;

(ii) the coolant temperature THW is higher than 50° C.;

(iii) The power fuel incremental amount FPOWER is 0; and (iv) the upstream-side $O_2$ sensor 13 is in an activated state.

Note that the determination of activation/non-activation of the upstream-side $O_2$ sensor 13 is carried out by determining whether or not the coolant temperature THW≧70° C., or by whether or not the output of the upstream-side $O_2$ sensor 13 is once swung, i.e., once changed from the rich side to the lean side, or vice versa. Of course, other feedback control conditions are introduced as occasion demands. However, an explanation of such other feedback control conditions is omitted.

If one of more of the feedback control conditions is not satisfied, the control proceeds to step 327, in which the amount FAF1 is caused to be 1.0 (FAF1=1.0), thereby carrying out an open-loop control operation. Note that, in this case, the amount FAF1 can be a value or a mean value immediately before the open-loop control operation. That is, the amount FAF1 or a mean value FAF1 thereof is stored in the backup RAM 106, and in an open-loop control operation, the value FAF1 or FAF1 is read out of the backup RAM 106.

Contrary to the above, at step 301, if all of the feedback control conditions are satisfied, the control proceeds to step 302.

At step 302, an A/D conversion is performed upon the output voltage $V_1$ of the upstream-side $O_2$ sensor 13, and the A/D converted value thereof is then fetched from the A/D converter 101. Then at step 303, the voltage $V_1$ is compared with a reference voltage $V_{R1}$ such as 0.45 V, thereby determining whether the current air-fuel ratio detected by the upstream-side $O_2$ sensor 11 is on the rich side or on the lean side with respect to the stoichiometric air-fuel ratio.

If $V_1 \leqq V_{R1}$, which means that the current air-fuel ratio is lean, the control proceeds to step 304, which determines whether or not the value of a first delay counter CDLY1 is positive. If CDLY1>0, the control proceeds to step 305, which clears the first delay counter CDLY1, and then proceeds to step 306. If CDLY1<0, the control proceeds directly to step 306. At step 306, the first delay counter CDLY1 is counted down by 1, and at step 307, it is determined whether or not CDLY1<TDL1. Note that TDL1 is a lean delay time period for which a rich state is maintained even after the output of the upstream-side $O_2$ sensor 13 is changed from the rich side to the lean side, and is defined by a negative value. Therefore, at step 307, only when CDLY1<TDL1 does the control proceed to step 308, which causes CDLY1 to be TDL1, and then to step 309, which causes a first air-fuel ratio flag F1 to be "0" (lean state). On the other hand, if $V_1 > V_{R1}$, which means that the current air-fuel ratio is rich, the control proceeds to step 310, which determines whether or not the value of the first delay counter CDLY1 is negative. If CDLY1<0, the control proceeds to step 311, which clears the first delay counter CDLY1, and then proceeds to step 312. If CDLY1≧0, the control directly proceeds to 312. At step 312, the first delay counter CDLY1 is counted up by 1, and at step 313, it is determined whether or not CDLY1>TDR1. Note that TDR1 is a rich delay time period for which a lean state is maintained even after the output of the upstream-side $O_2$ sensor 13 is changed from the lean side to the rich side, and is defined by a positive value. Therefore, at step 313, only when CDLY1>TDR1 does the control proceed to step 314, which causes CDLY1 to be TDR1, and then to step 315, which causes the first air-fuel ratio flag F1 to be "1" (rich state).

Next, at step 316, it is determined whether or not the first air-fuel ratio flag F1 is reversed, i.e., whether or not the delayed air-fuel ratio detected by the upstream-side $O_2$ sensor 13 is reversed. If the first air-fuel ratio flag F1 is reversed, the control proceeds to steps 317 to 319, which carry out a skip operation.

At step 317, if the flag F1 is "0" (lean) the control proceeds to step 318, which remarkably increases the correction amount FAF by a skip amount RSR. Also, if the flag F1 is "1" (rich) at step 317, the control proceeds to step 319, which remarkably decreases the correction amount FAF1 by the skip amount RSL.

On the other hand, if the first air-fuel ratio flag F1 is not reversed at step 316, the control proceeds to step 320 to 322, which carries out an integration operation. That is, if the flag F1 is "0" (lean) at step 320, the control proceeds to step 321, which gradually increases the correction amount FAF1 by a rich integration amount KIR. Also, if the flag F1 is "1" (rich) at step 320, the control proceeds to step 322, which gradually decreases the correction amount FAF1 by a lean integration amount KIL.

The correction amount FAF1 is guarded by a minimum value 0.8 at steps 323 and 324, and by a maximum value 1.2 at steps 325 and 326, thereby also preventing the controlled air-fuel ratio from becoming overrich or overlean.

The correction amount FAF1 is then stored in the RAM 105, thus completing this routine of FIG. 3 at step 328.

Figures 4A, 4B, 4C, 4D:
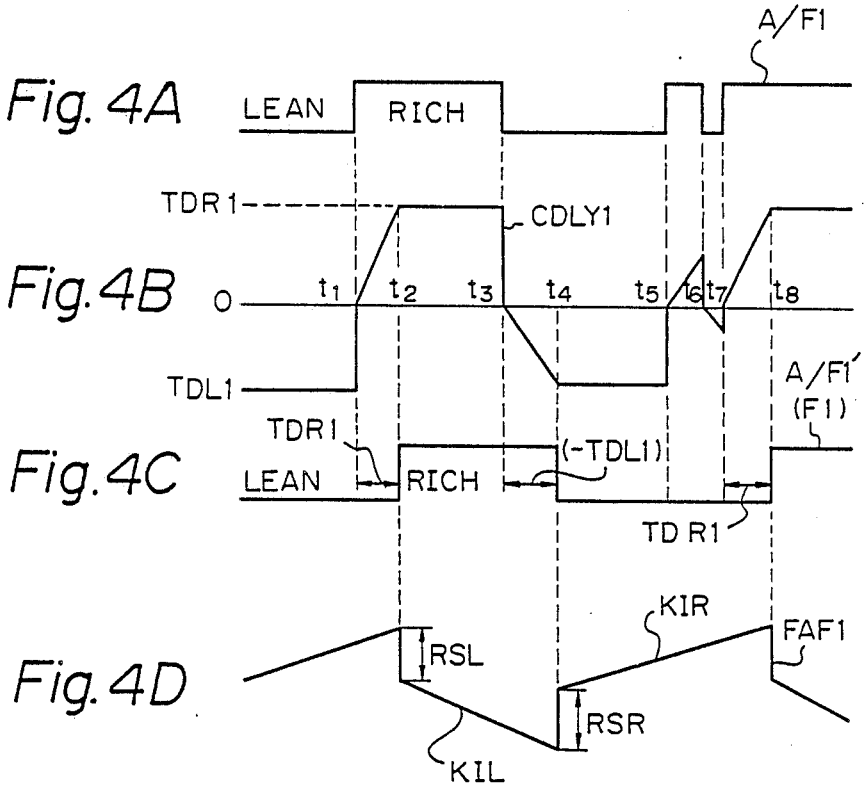
FIGS. 4A through 4D are timing diagrams explaining the flow chart of FIG. 4.

The operation by the flow chart of FIG. 3 will be further explained with reference to FIGS. 4A through 4D. As illustrated in FIG. 4A, when the air-fuel ratio A/F1 is obtained by the output of the upstream-side $O_2$ sensor 13, the first delay counter CDLY1 is counted up during a rich state, and is counted down during a lean state, as illustrated in FIG. 4B. As a result, a delayed air-fuel ratio corresponding to the first air-fuel ratio flag F1 is obtained as illustrated in FIG. 4C. For example, at time $t_1$, even when the air-fuel ratio A/F is changed from the lean side to the rich side, the delayed air-fuel ratio A/F1' (F1) is changed at time $t_2$ after the rich delay time period TDR1. Similarly, at time $t_3$, even when the air-fuel ratio A/F1 is changed from the rich side to the lean side, the delayed air-fuel ratio F1 is changed at time $t_4$ after the lean delay time period TDL1. However, at time $t_5$, $t_6$, or $t_7$, when the air-fuel ratio A/F1 is reversed within a smaller time period than the rich delay time period TDR1 or the lean delay time period TDL1, the delay air-fuel ratio A/F1' is reversed at time $t_8$. That is, the delayed air-fuel ratio A/F1' is stable when compared with the air-fuel ratio A/F1. Further, as illustrated in FIG. 4D, at every change of the delayed air-fuel ratio A/F1' from the rich side to the lean side, or vice versa, the correction amount FAF1 is skipped by the skip amount RSR or RSL, and in addition, the correction amount FAF1 is gradually increased or decreased in accordance with the delayed air-fuel ratio A/F1'.

Air-fuel ratio feedback control operations by the downstream-side $O_2$ sensor 15 will be explained. There are two types of air-fuel ratio feedback control operations by the downstream-side $O_2$ sensor 15, i.e., the operation type in which a second air-fuel ratio correction amount FAF2 is introduced thereinto, and the operation type in which an air-fuel ratio feedback control parameter in the air-fuel ratio feedback control operation by the upstream-side $O_2$ sensor 13 is variable. Further, as the air fuel ratio feedback control parameter, there are nominated a delay time period TD (in more detail, the rich delay time period TDR1 and the lean delay time period TDL1), a skip amount RS (in more detail, the rich skip amount RSR and the lean skip amount RSL), an integration amount KI (in more detail, the rich integration amount KIR and the lean integration amount KIL), and the reference voltage $V_{R1}$.

For example, if the rich delay time period becomes larger than the lean delay time period (TDR1>(−TDL1)), the controlled air-fuel becomes richer, and if the lean delay time period becomes larger than the rich delay time period ((−TDL1)>TDR1), the controlled air-fuel ratio becomes leaner. Thus, the air-fuel ratio can be controlled by changing the rich delay time period TDR1 and the lean delay time period (−TDL1) in accordance with the output of the downstream-side $O_2$ sensor 15. Also, if the rich skip amount RSR is increased or if the lean skip amount RSL is decreased, the controlled air-fuel ratio becomes richer, and if the lean skip amount RSL is increased or if the rich skip amount RSR is decreased, the controlled air-fuel ratio becomes leaner. Thus, the air-fuel ratio can be controlled by changing the rich skip amount RSR and the lean skip amount RSL in accordance with the output downstream-side $O_2$ sensor 15. Further, if the rich integration amount KIR is increased or if the lean integration amount KIL is decreased, the controlled air-fuel ratio becomes richer, and if the lean integration amount KIL is increased or if the rich integration amount KIR is decreased, the controlled air-fuel ratio becomes leaner. Thus, the air-fuel ratio can be controlled by changing the rich integration amount KIR and the lean integration amount KIL in accordance with the output of the downstream-side $O_2$ sensor 15. Still further, if the reference voltage $V_{R1}$ is increased, the controlled air-fuel ratio becomes richer, and if the reference voltage $V_{R1}$ is decreased, the controlled air-fuel ratio becomes leaner. Thus, the air-fuel ratio can be controlled by changing the reference voltage $V_{R1}$ in accordance with the output of the downstream-side $O_2$ sensor 15.

A double $O_2$ sensor system into which a second air-fuel ratio correction amount FAF2 is introduced will be explained with reference to FIGS. 5 and 6.

Figures 5, 5A:
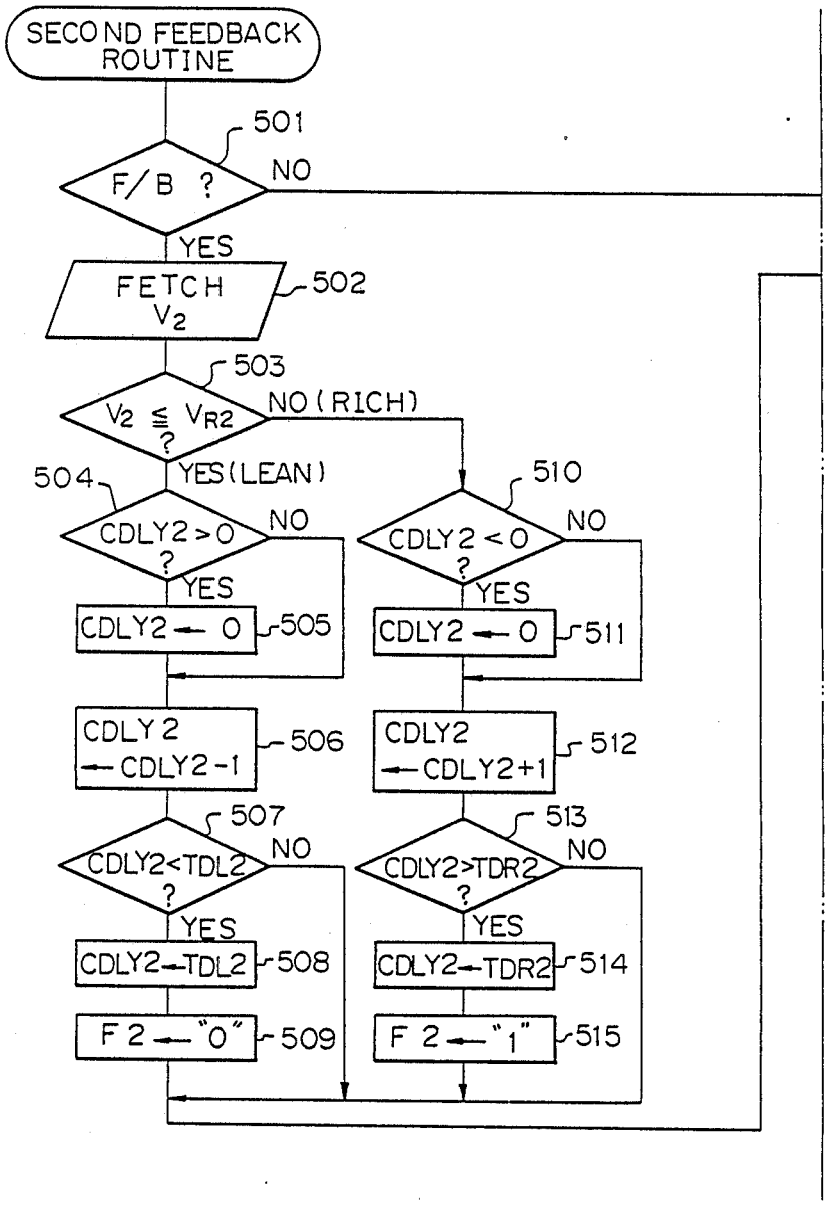
Figure 5B:
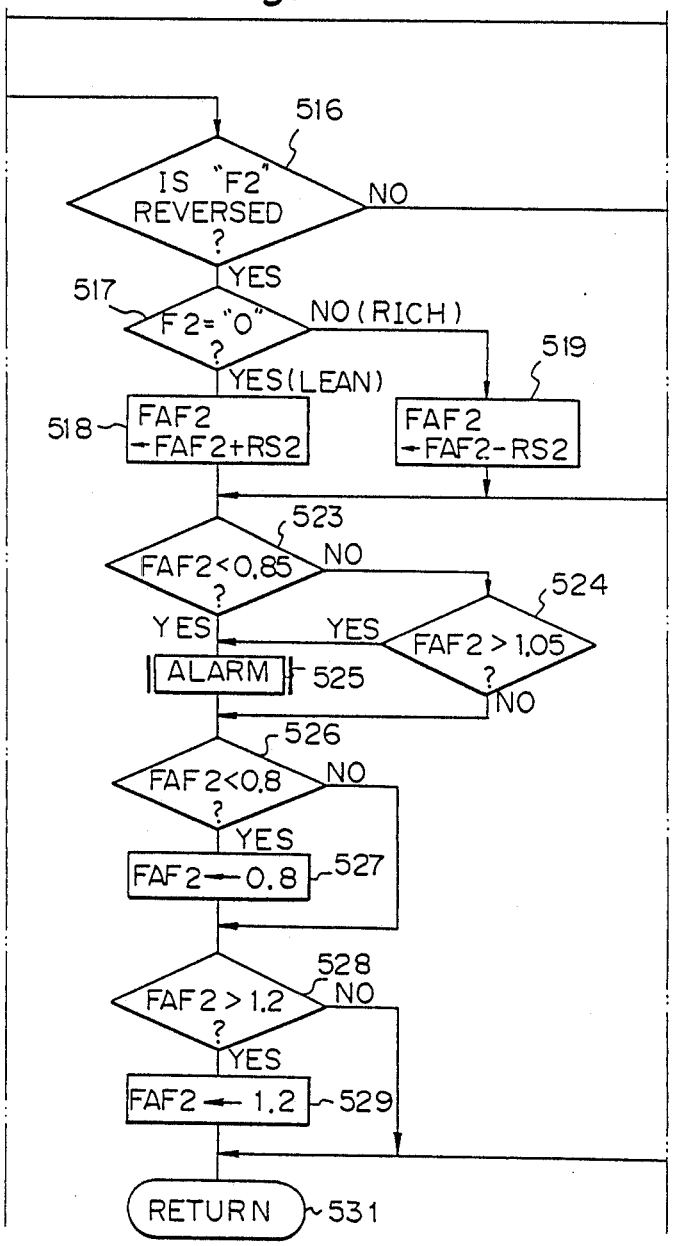
Figure 5C:
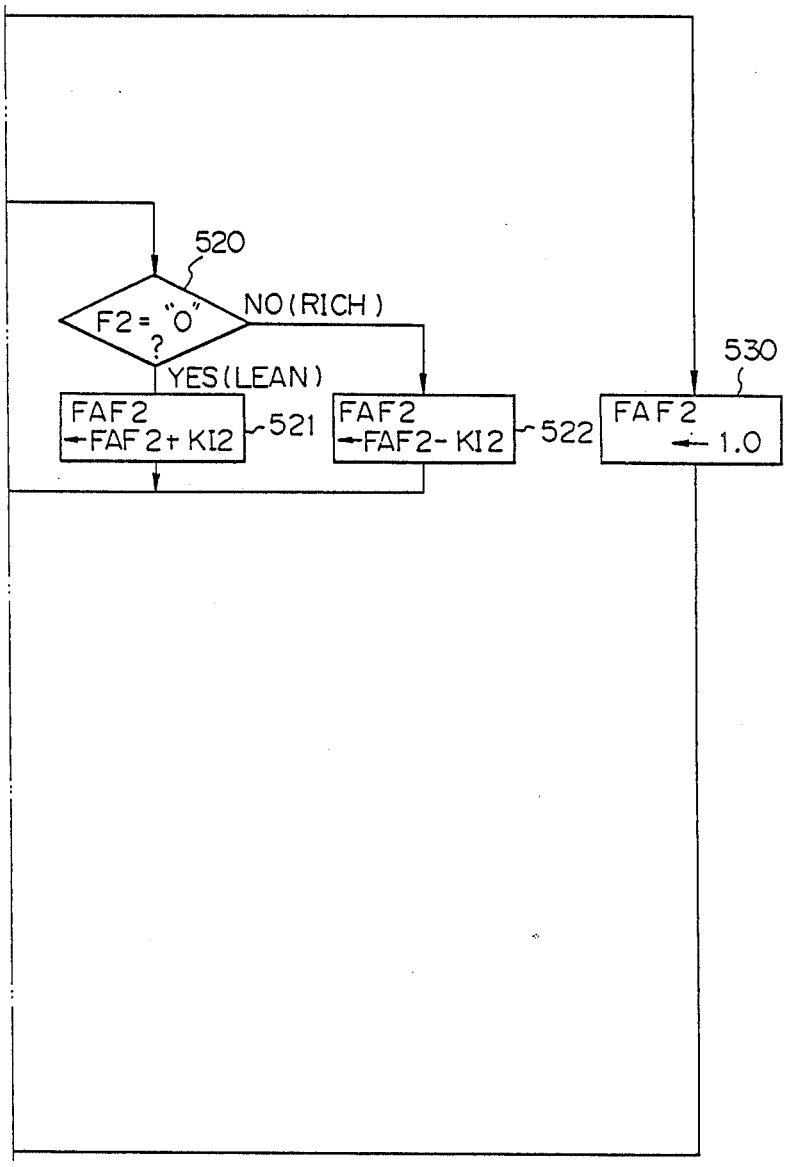

FIG. 5 is a routine for calculating a second air-fuel ratio feedback correction amount FAF2 in accordance with the output of the downstream-side $O_2$ sensor 15 executed at every predetermined time period such as 1 s.

At step 501, it is determined if all of the feedback control (closed-loop control) conditions by the downstream-side $O_2$ sensor 15 are satisfied. The feedback control conditions are as follows:

(i) all of the feedback control conditions by the upstream-side $O_2$ sensor 13 are satisfied; and (ii) the downstream-side $O_2$ sensor 15 is in an activated state.

Note that the determination of activation/non-activation of the downstream-side $O_2$ sensor 15 is carried out by determining whether or not the coolant temperature THW≧70° C., or by whether or not the output of the downstream-side $O_2$ sensor 15 is once swung, e.g., once changed from the rich side to the lean side, or vice versa. Of course, other feedback control conditions are introduced as occasion demands. However, an explanation of such other feedback control conditions is omitted.

If one or more of the feedback control conditions is not satisfied, the control proceeds to step 530, in which the amount FAF2 is caused to be 1.0 (FAF2=1.0), thereby carrying out an open-loop control operation. Note that, in this case, the amount FAF2 can be a value or a mean value immediately before the open-loop control operation. That is, the amount FAF2 or a mean value FAF2 thereof is stored in the backup RAM 106, and in an open-loop control operation, the value FAF2 or FAF2 is read out of the backup RAM 106.

Contrary to the above, at step 501, if all of the feedback control conditions are satisfied, the control proceeds to step 502.

At step 502, an A/D conversion is performed upon the output voltage $V_2$ of the downstream-side $O_2$ sensor 15, and the A/D converted value thereof is then fetched from the A/D converter 101. Then, at step 503, the voltage $V_2$ is compared with a reference voltage $V_{R2}$ such as 0.55 V, thereby determining whether the current air-fuel ratio detected by the downstream-side $O_2$ sensor 15 is on the rich side or on the lean side with respect to the stoichiometric air-fuel ratio. Note that the reference voltage $V_{R2}$ (=0.55 V) is preferably higher that the reference voltage $V_{R1}$ (=0.45 V), in consideration of the difference in output characteristics and deterioration speed between the $O_2$ sensor 13 upstream of the catalyst converter 12 and the $O_2$ sensor 15 downstream of the catalyst converter 12. However, the voltage $V_{R2}$ can be voluntarily determined.

Steps 504 through 515 correspond to step 304 through 315, respectively, of FIG. 3, thereby performing a delay operation upon the determination at step 503. Here, a rich delay time period is defined by TDR2, and a lean delay time period is defined by TDL2. As a result of the delayed determination, if the air-fuel ratio is rich, a second air-fuel ratio flag F2 is caused to be "1", and if the air-fuel ratio is lean, the second air-fuel ratio flag F2 is caused to be "0".

Next, at step 616, it is determined whether or not the second air-fuel ratio flag F2 is reversed, i.e., whether or not the delayed air-fuel ratio detected by the downstream-side $O_2$ sensor 15 is reversed. If the second air-fuel ratio flag $F_2$ is reversed, the control proceeds to steps 517 to 519 which carry out a skip operation. That is, if the flag F2 is "0" (lean) at step 517, the control proceeds to step 518, which remarkably increases the second correction amount FAF2 by skip amount RS2. Also, if the flag F2 is "1" (rich) at step 517, the control proceeds to step 519, which remarkably decreases the second correction amount FAF2 by the skip amount RS2. On the other hand, if the second air-fuel ratio flag F2 is not reversed at step 516, the control proceeds to steps 520 to 522, which carries out an integration operation. That is, if the flag F2 is "0" (lean) at step 520, the control proceeds to step 521, which gradually increases the second correction amount FAF2 by an integration amount KI2. Also, if the flag F2 is "1" (rich) at step 520, the control proceeds to step 522, which gradually decreases the second correction amount FAF2 by the integration amount KI2.

Note that the skip amount RS2 is larger than the integration amount KI2.

At step 523, it is determined whether or not the second air-fuel ratio correction amount FAF2 is smaller than a lower limit such as 0.85. Also, at step 524, it is determined whether or not the second air-fuel ratio correction amount FAF2 is larger than an upper limit such as 1.05. Note that the amount FAF2 reaches the lower or upper limit only when the upstream-side $O_2$ sensor 13 or the fuel injection valve 7 is in an abnormal state, or in a deterioration state, and these lower and upper limits are experimentally determined.

Therefore, if $FAF2<0.85$ or $FAF2>1.05$, the control proceeds to step 525 which activates the alarm 16, and the activation of the alarm 16 is stored in the backup RAM 106.

The second correction amount FAF2 is guarded by a minimum value 0.8 at steps 523 and 524, and by a maximum value 1.2 at steps 525 and 526, thereby also preventing the controlled air-fuel ratio from becoming overrich or overlean.

The correction amount FAF2 is then stored in the RAM 105, thus completing this routine of FIG. 5 at step 531.

Figure 6:
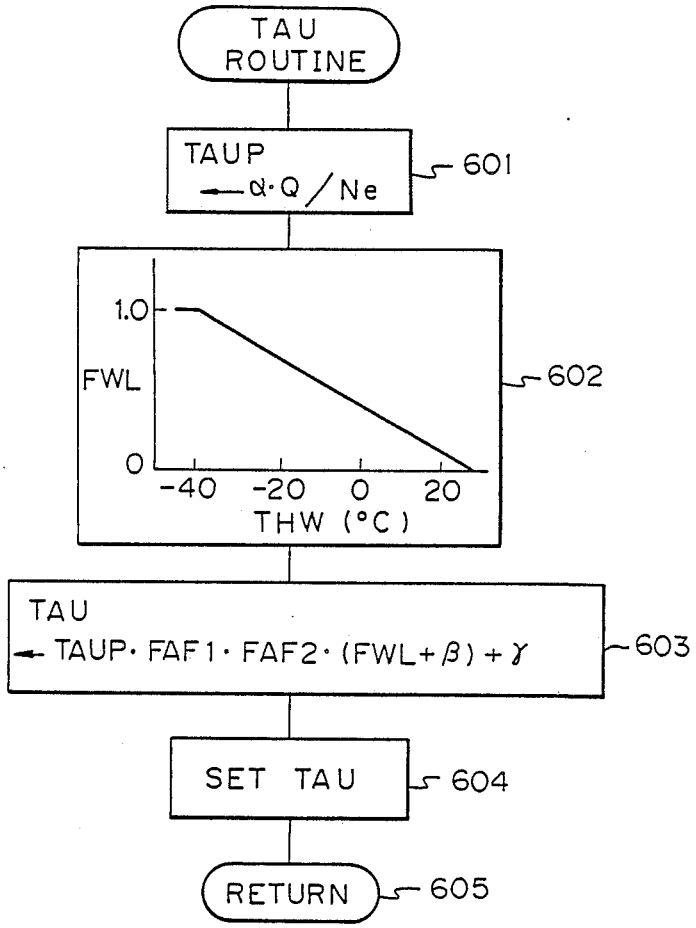

FIG. 6 is a routine for calculating a fuel injection amount TAU executed at every predetermined crank angle such as 360° CA. At step 501, a base fuel injection amount TAUP is calculated by using the intake air amount data Q and the engine speed data Ne stored in the RAM 105. That is, $$TAUP \leftarrow \alpha.Q/Ne$$

where $\alpha$ is a constant. Then at step 602, a warming-up incremental amount FWL is calculated from a one-dimensional map stored in the ROM 104 by using the coolant temperature data THW stored in the RAM 105. Note that the warming-up incremental amount FWL decreases when the coolant temperature THW increases. At step 613, a final fuel injection amount TAU is calculated by $$TAU \leftarrow TAUP.FAF1.FAF2.(FWL+\beta)+\gamma$$

where $\beta$ and $\gamma$ are correction factors determined by other parameters such as the voltage of the battery and the temperature of the intake air. At step 604, the final fuel injection amount TAU is set in the down counter 107, and in addition, the flip-flop 108 is set to initiate the activation of the fuel injection valve 7. Then, this routine is completed by step 605. Note that, as explained above, when a time period corresponding to the amount TAU has passed, the flip-flop 109 is reset by the carry-out signal of the down counter 108 to stop the activation of the fuel injection valve 7.

Figures 7A, 7B, 7C, 7D, 7E, 7F, 7G, 7H:
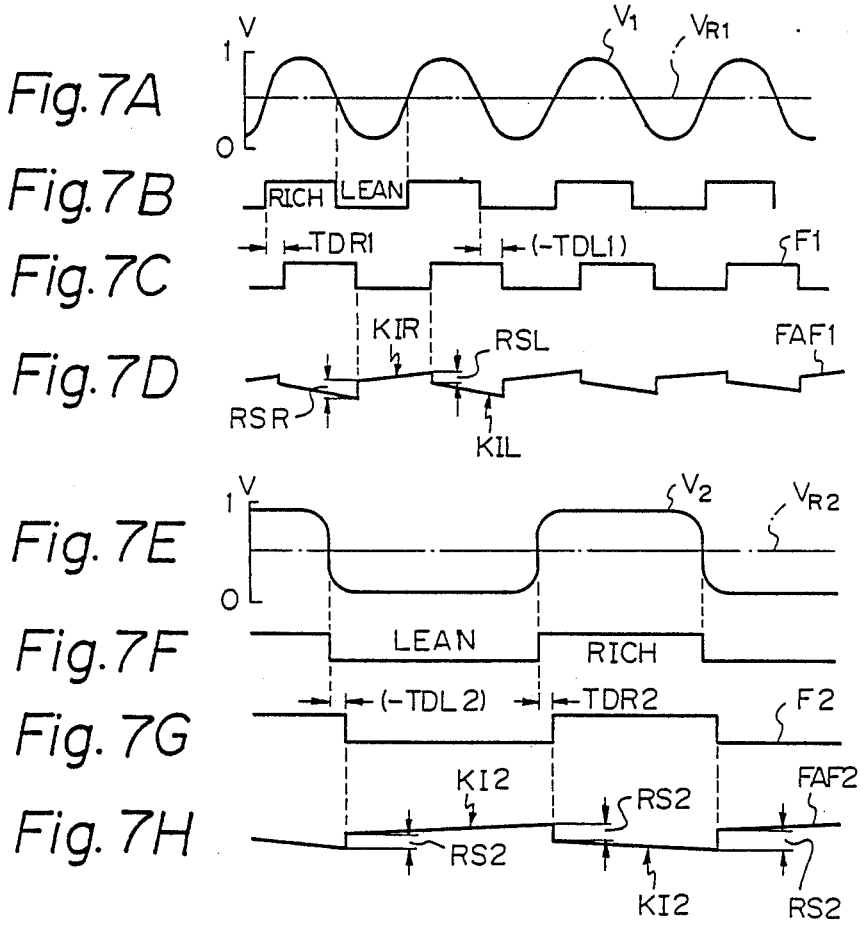
FIGS. 7A through 7H, and FIGS. 8A and 8B are timing diagrams explaining the flow charts of FIGS. 3, 5, and 6.

FIGS. 7A through 7H are timing diagrams for explaining the two air-fuel ratio correction amounts FAF1 and FAF2 obtained by the flow charts of FIGS. 3, 5, and 6. In this case, the engine is in a closed-loop control state for the two $O_2$ sensors 13 and 15. When the output of the upstream-side $O_2$ sensor 3 is changed as illustrated in FIG. 7A, the determination at step 303 of FIG. 3 is shown in FIG. 7B, and a delayed determination thereof corresponding to the first air-fuel ratio flag F1 is shown in FIG. 7C. As a result, as shown in FIG. 7D, every time the delayed determination is changed from the rich side to the lean side, or vice versa, the first air-fuel ratio correction amount FAF1 is skipped by the amount RSR or RSL. On the other hand, when the output of the downstream-side $O_2$ sensor 15 is changed as illustrated in FIG. 7E, the determination at step 503 of FIG. 5 is shown in FIG. 7F, and the delayed determination thereof corresponding to the second air-fuel ratio flag F2 is shown in FIG. 7G. As a result, as shown in FIG. 7H, every time the delayed determination is changed from the rich side to the lean side, or vice versa, the second air-fuel ratio correction amount FAF2 is skipped by the skip amount RS2.

Figures 8A, 8B:
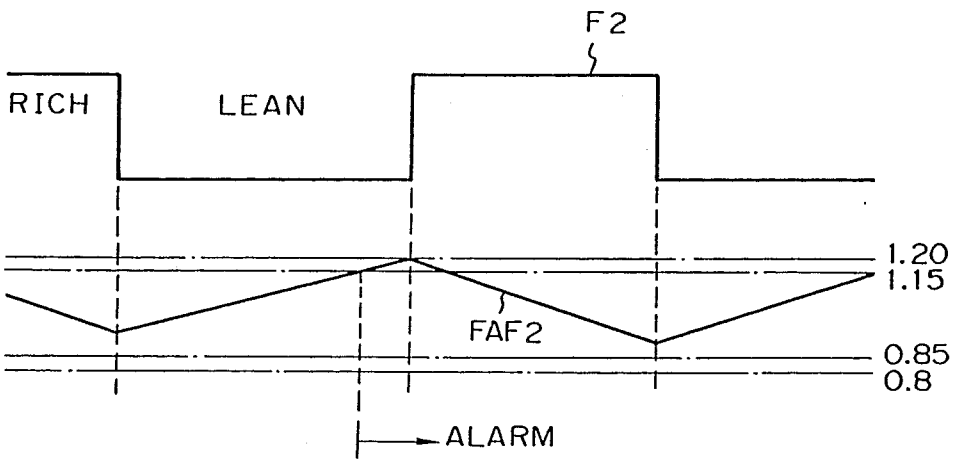

If the second air-fuel ratio correction amount FAF2 reaches the lower limit 0.85 or the upper limit 1.05, as shown in FIGS. 8A and 8B, an alarm is generated. Note that, in this case, the air-fuel ratio feedback control by the downstream-side $O_2$ sensor 15 is not prohibited even though an alarm is generated. Therefore, the exhaust emissions will be compensated until the exchange of components is carried out.

A double $O_2$ sensor system, in which an air-fuel ratio feedback control parameter of the first air-fuel ratio feedback control by the upstream-side $O_2$ sensor is variable, will be explained with reference to FIGS. 9 and 10. In this case, the skip amounts RSR and RSL as the air-fuel ratio feedback control parameters are variable.

Figures 9, 9A:
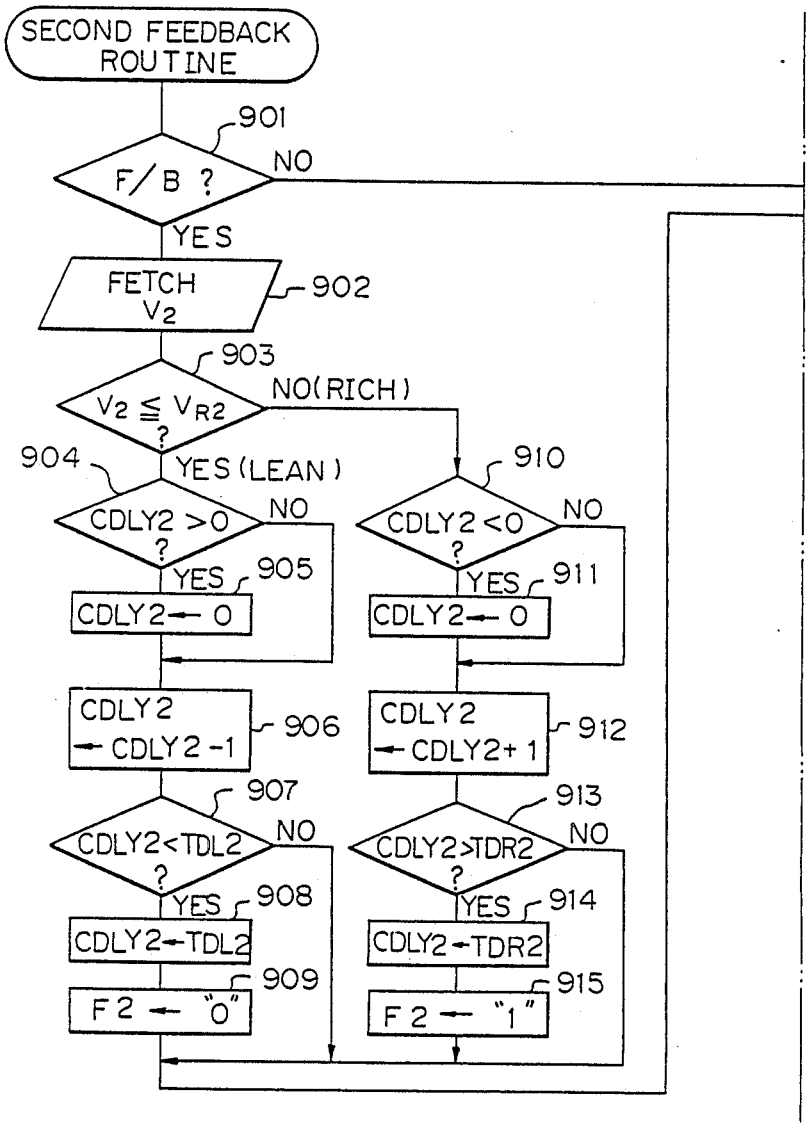
Figure 9B:
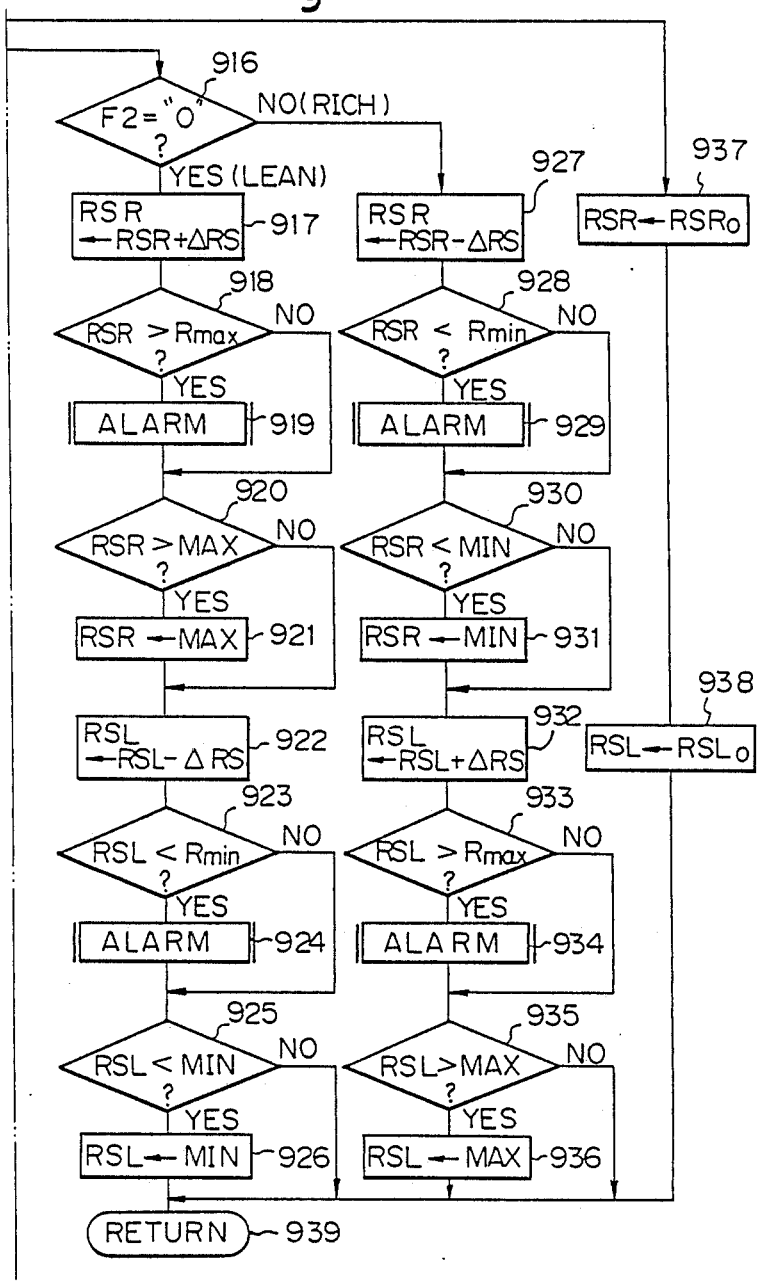

FIG. 9 is a routine for calculating the skip amounts RSR and RSL in accordance with the output of the downstream-side $O_2$ sensor 15 executed at every predetermined time period such as 1 s.

Steps 901 through 915 are the same as steps 501 through 515 of FIG. 5. That is, if one or more of the feedback control conditions is not satisfied, the control proceeds to steps 937 and 938, thereby carrying out an open-loop control operation. For example, the rich skip amount RSR and the lean skip amount RSL are made definite values $RSR_0$ and $RSL_0$ which are, for example, 5%. Note that, in this case, the amounts RSR and RSL can be values or mean values immediately before the open-loop control operation. That is, the amounts RSR and RSL or the mean values $\overline{RSR}$ and $\overline{RSL}$ thereof are stored in the backup RAM 106, and in an open-loop control operation, the values RSR and RSL or $\overline{RSR}$ and $\overline{RSL}$ are read out of the backup RAM 106.

Contrary to the above, if all of the feedback control conditions are satisfied, the second air-fuel ratio flag F2 is determined by the routine of steps 902 through 915.

At step 916, it is determined whether or not the second air-fuel ratio F2 is "0". If F2="0", which means that the air-fuel ratio is lean, the control proceeds to steps 917 through 926, and if F2="1", which means that the air-fuel ratio is rich, the control proceeds to step 927 through 936.

At step 917, the rich skip amount RSR is increased by a definite value ΔRS which is, for example, 0.08, to move the air-fuel ratio to the rich side.

At step 918, it is determined whether or not the rich skip amount RSR is larger than an upper limit $R_{max}$. Note that the amount RSR reaches the upper limit $R_{max}$ only when the upstream-side $O_2$ sensor 13 or the fuel injection valve 7 is in an abnormal state or in a deterioration state, and the upper limit $R_{max}$ is experimentally determined. Therefore, if $RSR > R_{max}$, the control proceeds to step 919, in which the alarm 16 is activated and the activation of the alarm 16 is stored in the backup RAM 106. If $RSR \leqq R_{max}$, the control proceeds directly to step 920.

At steps 920 and 921, the rich skip amount RSR is guarded by a maximum value MAX which is, for example, 6.2%. Here, the upper limit $R_{max}$ is smaller than the maximum value MAX.

At step 922, the lean skip amount RSL is decreased by the definite value ΔRS to move the air-fuel ratio to the rich side.

At step 923, it is determined whether or not the lean skip amount RSL is smaller than a lower limit $R_{min}$. Note that the amount RSL reaches the lower limit $R_{min}$ only when the upstream-side $O_2$ sensor 13 or the fuel injection valve 7 is in an abnormal state or in a deterioration state, and the lower limit $R_{min}$ is experimentally determined. Therefore, if $RSL < R_{min}$, the control proceeds to step 924, in which the alarm 16 is activated and the activation of the alarm 16 is stored on the backup RAM 106. If $RSL \geqq R_{min}$, the control proceeds directly to step 939.

At steps 925 and 926, the lean skip amount RSL is guarded by a minimum value MIN which is, for example, 2.5%. Here, the lower limit $R_{min}$ is larger than the minimum value MIN.

On the other hand, if F2="1" (rich), at step 927, the rich skip amount RSR is decreased by the definite value ΔRS to move the air-fuel ratio to the lean side. At steps 928 and 929, it is determined whether or not the rich skip amount RSR is smaller than the lower limit $R_{min}$, and as a result, if $RSR < R_{min}$, the alarm 15 is activated. At steps 930 and 931, the rich skip amount RSR is guarded by the minimum value MIN. Further, at step 932, the lean skip amount RSL is decreased by the definite value ΔRS to move the air-fuel ratio to the rich side. At steps 933 and 934, it is determined whether or not the lean skip amount RSL is larger than the upper limit $R_{max}$, and as a result, if $RSL > R_{max}$, the alarm 16 is activated. At steps 935 and 936, the lean skip amount RSL is guarded by the maximum value MAX.

The skip amounts RSR and RSL are then stored in the RAM 105, thereby completing this routine of FIG. 9 at step 939.

Thus, according to the routine of FIG. 9, when the delayed output of the second $O_2$ sensor 15 is lean, the rich skip amount RSR is gradually increased, and the lean skip amount RSL is gradually decreased, thereby moving the air-fuel ratio to the rich side. Contrary to this, when the delayed output of the second $O_2$ sensor 15 is rich, the rich skip amount RSR is gradually decreased, and the lean skip amount RSL is gradually increased, thereby moving the air-fuel ratio to the lean side. In this case, when the amount RSR or RSL reaches the upper limit $R_{max}$ or the lower limit $R_{min}$, the upstream-side $O_2$ sensor 13 or the fuel injection valve 7 is considered to be in an abnormal state or in a deterioration state, so that the alarm 16 is activated and the activation is stored in the backup RAM 106.

Figure 10:
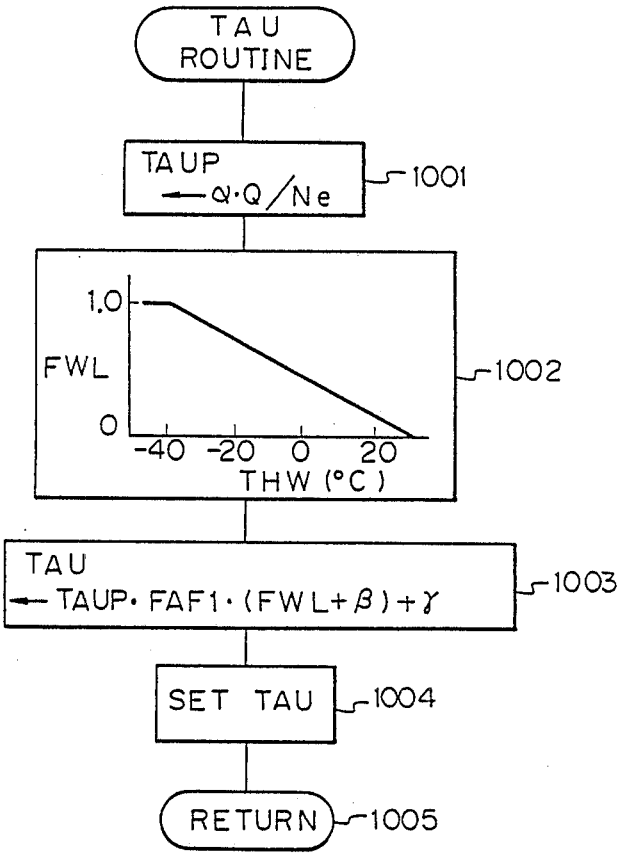

FIG. 10 is a routine for calculating a fuel injection amount TAU executed at every predetermined crank angle such as 360° CA. At step 1001, a base fuel injection amount TAUP is calculated by using the intake air amount data Q and the engine speed data Ne stored in the RAM 105. That is, $$TAUP \leftarrow \alpha . Q/Ne$$

where α is a constant. Then at step 1002, a warming-up incremental amount FWL is calculated from a one-dimensional map by using the coolant temperature data THW stored in the RAM 105. Note that the warming-up incremental amount FWL decreases when the coolant temperature THW increases. At step 1003, a final fuel injection amount TAU is calculated by $$TAU \leftarrow TAUP.FAF1.(FWL+\beta)+\gamma$$

where β and γ are correction factors determined by other parameters such as the voltage of the battery and the temperature of the intake air. At step 1004, the final fuel injection amount TAU is set in the down counter 108, and in addition, the flip-flop 109 is set to initiate the activation of the fuel injection valve 7. Then, this routine is completed by step 1005. Note that, as explained above, when a time period corresponding to the amount TAU has passed, the flip-flop 109 is reset by the carry-out signal of the down counter 108 to stop the activation of the fuel injection value 7.

Figures 11A, 11B, 11C, 11D, 11E, 11F, 11G, 11H, 11I:
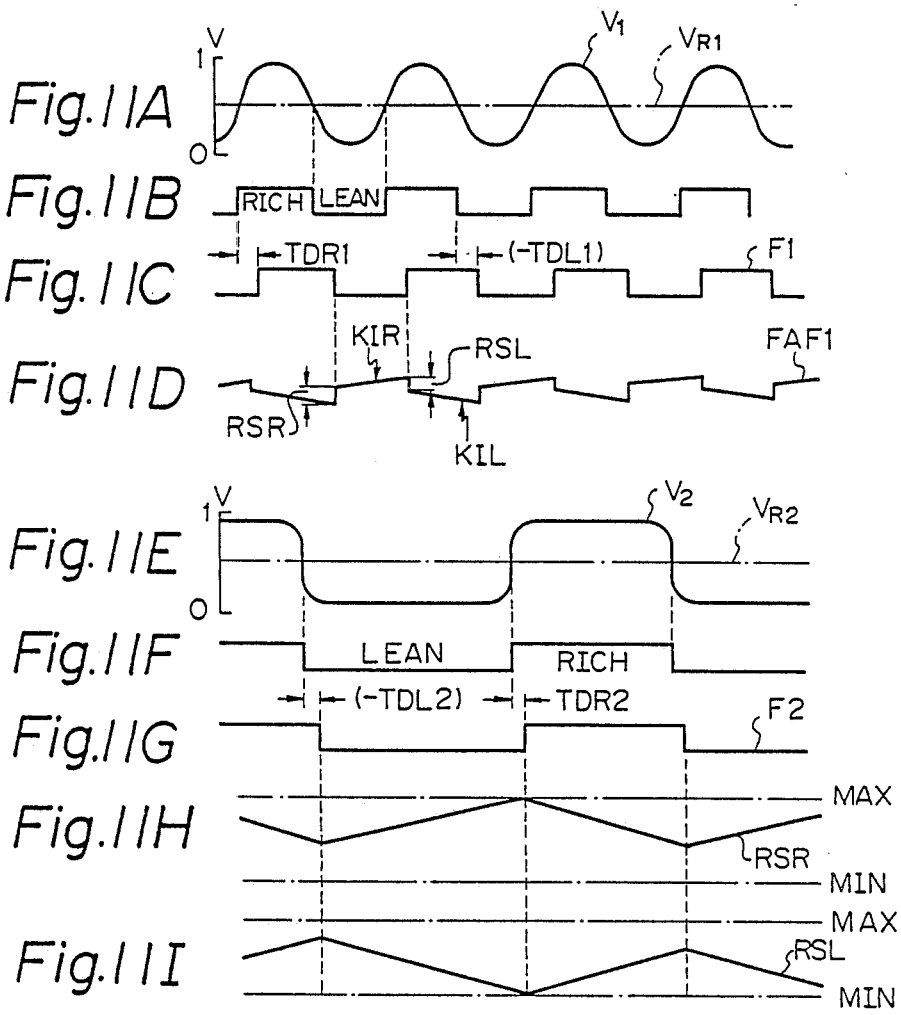
FIGS. 11A through 11I, and FIGS. 12A, 12B, and 12C are timing diagrams explaining the flow charts of FIGS. 3, 8, and 10.

FIGS. 11A through 11I are timing diagrams for explaining the air-fuel ratio correction amount FAF1 and the skip amounts RSR and RSL obtained by the flow charts of FIGS. 3, 9 and 10. FIGS. 11A through 11G are the same as FIGS. 7A through 7G, respectively. As shown in FIGS. 11H and 11I, when the delayed determination F2 is lean, the rich skip amount RSR is increased and the lean skip amount RSL is decreased, and when the delayed determination F2 is rich, the rich skip amount RSR is decreased and the lean skip amount RSL is increased. In this case, the skip amounts RSR and RSL are changed within a range of from MAX to MIN.

Figures 12A, 12B, 12C:
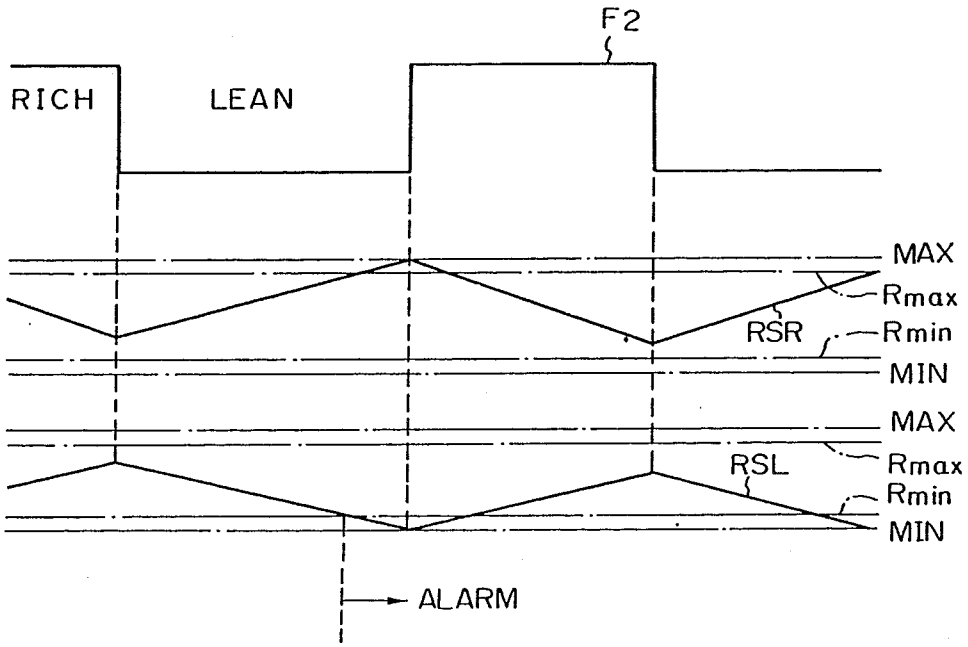

If the rich skip amount RSR or the lean skip amount RSL reaches the upper limit $R_{max}$ or the lower limit $R_{min}$, as shown in FIGS. 12A, 12B, and 12C, an alarm is generated.

Also, in this case, the air-fuel ratio feedback control by the downstream-side $O_2$ sensor 15 is not prohibited even though an alarm is generated. Therefore, the exhaust emissions will be compensated until the exchange of components is carried out.

In the above-mentioned embodiment, an abnormal state (or a deterioration state) of the upstream-side $O_2$ sensor 13 (or the fuel injection valve 7) is detected by the second air-fuel ratio correction amount FAF2 or the air-fuel ratio feedback control parameters such as RSR and RSL. However, it is possible to detect such a state by using the output of the upstream-side $O_2$ sensor 13, which will be explained with reference to FIGS. 13, 14, and 15.

Figure 13:
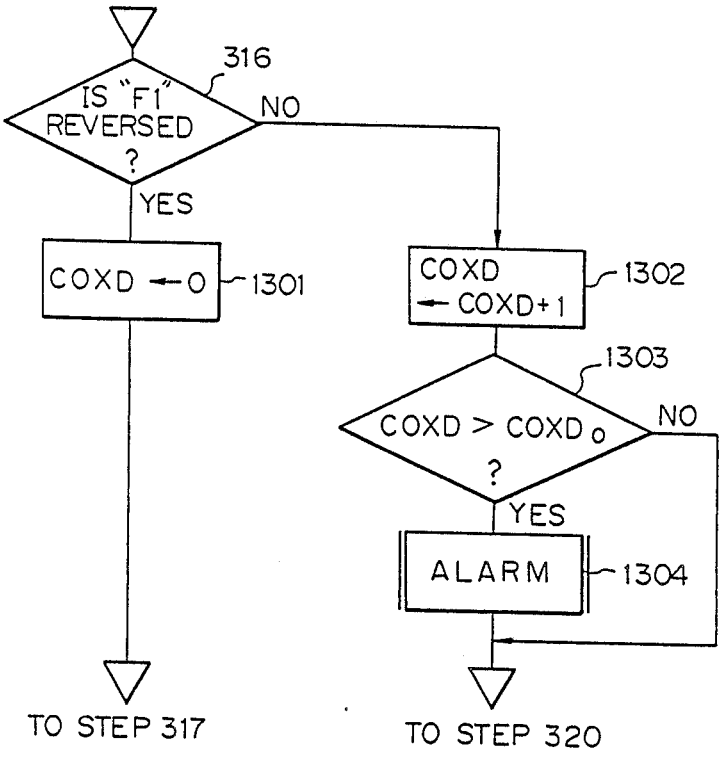

In FIG. 13, which is a modification of FIG. 5, the above-mentioned state is detected by a period lapsed after the output of the upstream-side $O_2$ sensor 13 is reversed. That is, at step 316, it is determined whether or not the flag F1, which shows the delayed air-fuel ratio detected by the upstream-side $O_2$ sensor 13, is reversed. If the flag F1 is reversed, i.e., if the upstream-side $O_2$ sensor 13 is activated, the control proceeds to step 1301 which clears a counter COXD. Conversely, if the flag F1 is not reversed, i.e., if the upstream-side $O_2$ sensor 13 is not activated, the control proceeds to step 1302 which counts up the counter COXD by +1. Then, at step 1303, it is determined whether or not the value of the counter COXD is larger than a predetermined valve COXD0 As a result, if $COXD > COXD_0$, this denotes that the upstream-side $O_2$ sensor 13 (or the fuel injection valve 7) is in an abnormal state (or in a deterioration state), and as a result, the control proceeds to step 1304 in which the alarm 16 is activated and the activation is stored in the backup RAM 106.

Figure 14:
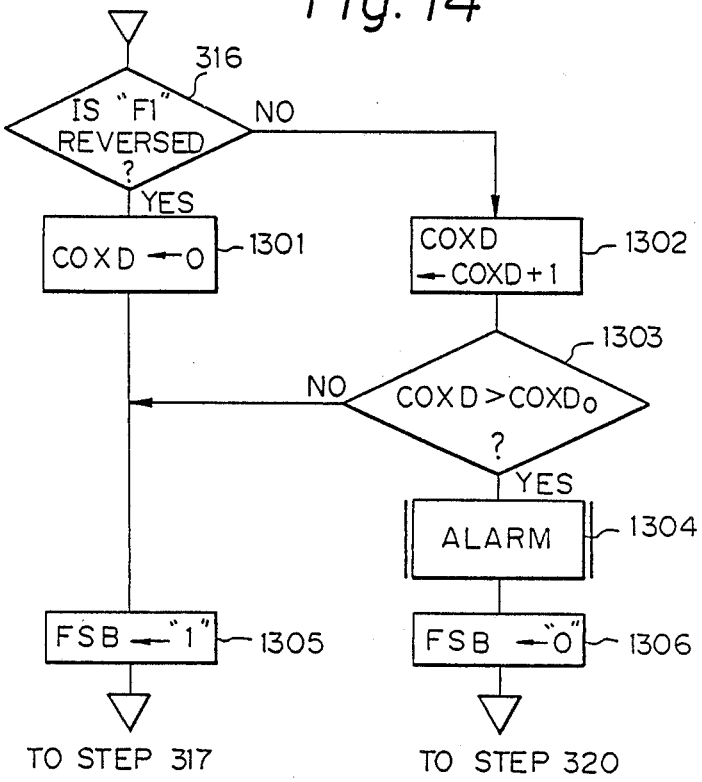

Also, in FIG. 14, which is a modification of FIG. 13, steps 1305 and 1306 are added to the steps of FIG. 13. That is, when $COXD \leqq COXD_0$, the control proceeds to step 1305 which sets a second air-fuel ratio feedback control flag FSB, and when $COXD > COXD_0$, the control proceeds to step 1306 which sets the flag FSB. Note that the flag FSB is used for the substantive execution of the second air-fuel feedback routine as illustrated in FIGS. 5 or 9. That is, in FIG. 15, which is a modification of FIGS. 5 or 9, the control at step 501 or 901 proceeds to step 1501 which determines whether or not the control flag FSB is "1". If FSB="1", the control proceeds to step 502 or 902 thereby substantially carrying out an air-fuel ratio feedback control by the downstream-side $O_2$ sensor 15, and if FSB="0", the control proceeds to step 530 or 937 which carries out an open-loop control by the downstream-side $O_2$ sensor 15.

Figure 15:
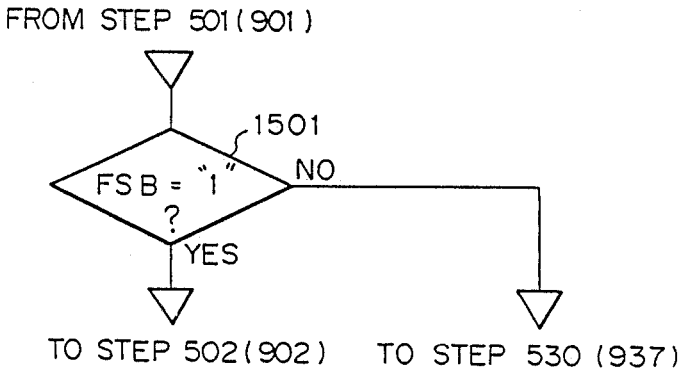

Thus, according to the routines of FIGS. 14 and 15, when the upstream-side $O_2$ sensor 13 or the fuel injection valve 7 resumes a normal state, after being in an abnormal state or in a deterioration state in which the air-fuel ratio feedback control by the downstream-side $O_2$ sensor 15 is prohibited, the exhaust emissions are not increased.

Note that the calculated parameters FAF1 and FAF2, or FAF1, RSR, and RSL can be stored in the backup RAM 106, thereby improving drivability at the restarting of the engine.

Figure 16:
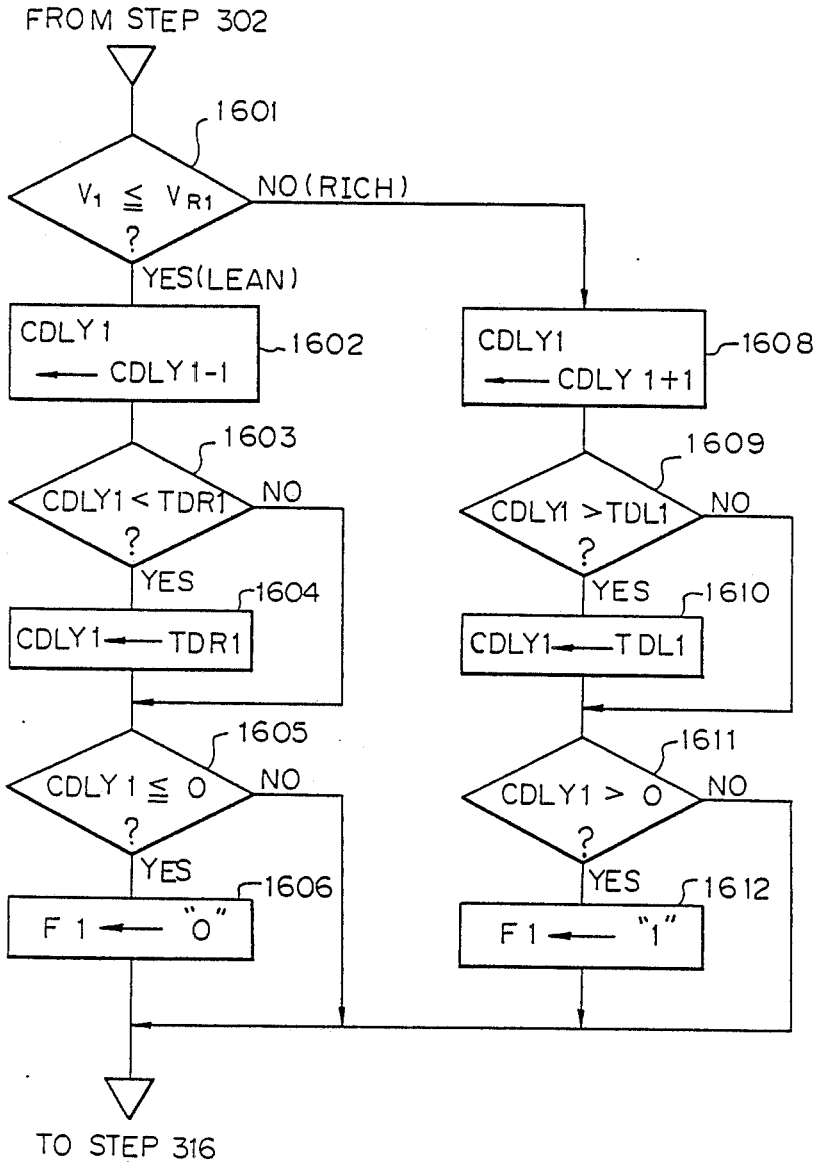

In FIG. 16, which is a modification of FIG. 3, a delay operation different from that of FIG. 3 is carried out. That is, at step 1601, if $V_1 \leqq V_{R1}$, which means that the current air-fuel ratio is lean, the control proceeds to steps 1602 which decreases a first delay counter CDLY1 by 1. Then, at steps 1603 and 1604, the first delay counter CDLY1 is guarded by a minimum value TDR1. Note that TDR1 is a rich delay time period for which a lean state is maintained even after the output of the upstream-side $O_2$ sensor 13 is changed from the lean side to the rich side, and is defined by a negative value.

Note that, in this case, if CDLY1>0, then the delayed air-fuel ratio is rich, and if CDLY1≦0, then the delayed air-fuel ratio is lean.

Therefore, at step 1605, it is determined whether or not CDLY1≦0 is satisfied. As a result, if CDLY1<0, at step 1606, the first air-fuel ratio flag F1 is caused to be "0" (lean). Otherwise, the first air-fuel ratio flag F1 is unchanged; that is, the flag F1 remains at "1".

On the other hand, if $V_1 > V_{R1}$, which means that the current air-fuel ratio is rich, the control proceeds to step 1608 which increases the first delay counter CDLY1 by 1. Then, at steps 1609 and 1610, the first delay counter CDLY1 is guarded by a maximum value TDL1. Note that TDL1 is a lean delay time period for which a rich state is maintained even after the output of the upstream-side $O_2$ sensor 13 is changed from the rich side to the lean side, and is defined by a positive value.

Then, at step 1611, it is determined whether or not CDLY1>0 is satisfied. As a result, if CDLY1>0, at step 1612, the first air-fuel ratio flag F1 is caused to be "1" (rich). Otherwise, the first air-fuel ratio flag F1 is unchanged; that is, the flag F1 remains at "0".

Figures 17A, 17B, 17C, 17D:
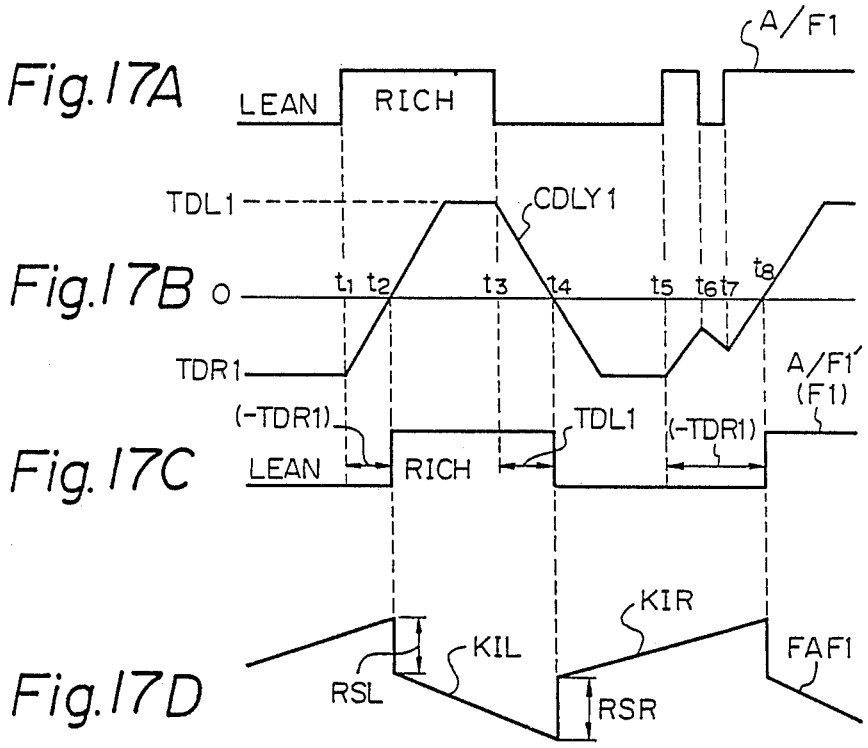
FIGS. 17A through 17D are timing diagrams explaining the flow chart of FIG. 16.

The operation by the flow chart of FIG. 16 will be further explained with reference to FIGS. 17A through 17D. As illustrated in FIGS. 17A, when the air-fuel ratio A/F1 is obtained by the output of the upstream-side $O_2$ sensor 13, the first delay counter CDLY1 is counted up during a rich state, and is counted down during a lean state, as illustrated in FIG. 17B. As a result, the delayed air-fuel ratio A/F1′ is obtained as illustrated in FIG. 17C. For example, at time $t_1$, even when the air-fuel ratio A/F1 is changed from the lean side to the rich side, the delayed air-fuel ratio A/F1 is changed at time $t_2$ after the rich delay time period TDR1. Similarly, at time $t_3$, even when the air-fuel ratio A/F1 is changed from the rich side to the lean side, the delayed air-fuel ratio A/F1′ is changed at time $t_4$ after the lean delay time period TDL1. However, at time $t_5$, $t_6$, or $t_7$, when the air-fuel ratio A/F is reversed within a smaller time period than the rich delay time period TDR1 or the lean delay time period TDL1, the delayed air-fuel ratio A/F1′ is reversed at time $t_8$; that is, the delayed air-fuel ratio A/F1′ is stable when compared with the air-fuel ratio A/F1. Further, as illustrated in FIG. 17D, at every change of the delayed air-fuel ratio A/F1′ from the rich side to the lean side, or vice versa, the correction amount FAF1 is skipped by the skip amount RSR or RSL, and in addition, the correction amount FAF1 is gradually increased or decreased in accordance with the delayed air-fuel ratio A/F1′.

Note that, in this case, during an open-control mode, the rich delay time period TDR1 is, for example, −12 (48 ms), and the lean delay time period TDL1 is, for example, 6 (24 ms).

Figure 18:
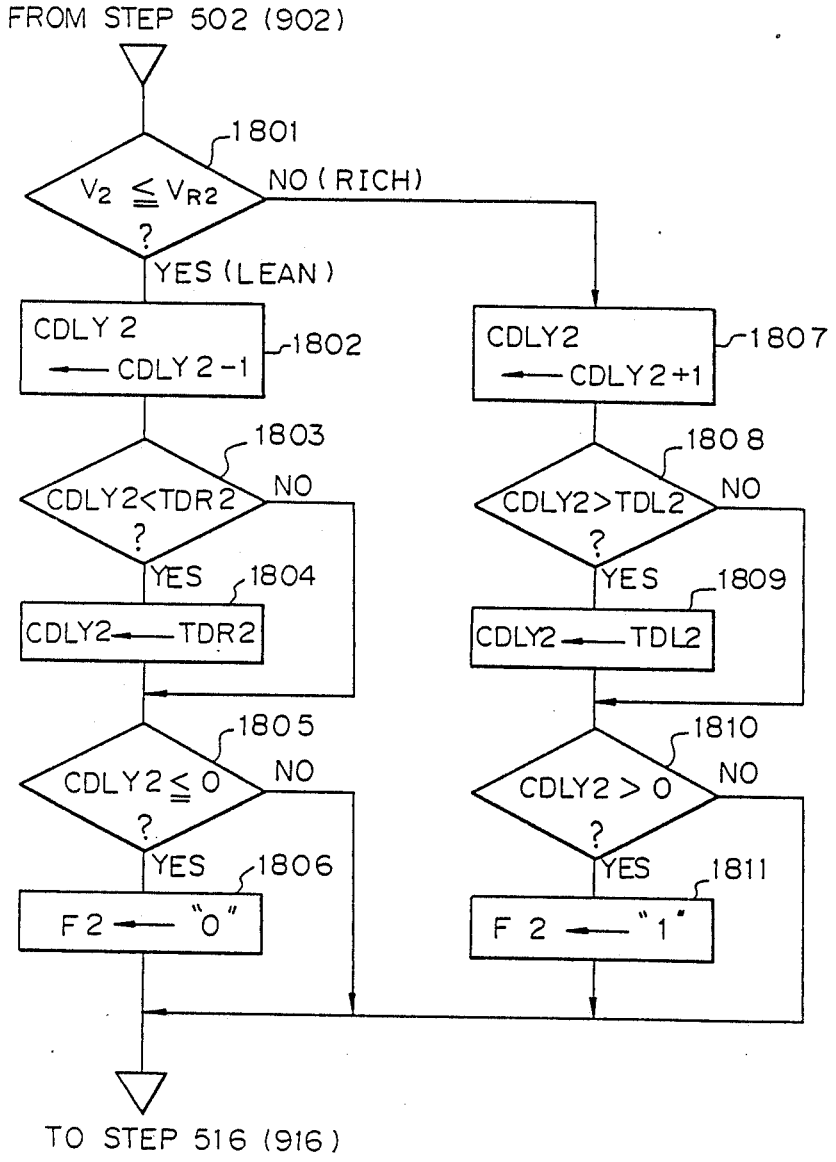

In FIG. 18, which is a modification of FIGS. 5 or 9, the same delay operation as in FIG. 16 is carried out, and therefore, a detailed explanation thereof is omitted.

Also, the first air-fuel ratio feedback control by the upstream-side $O_2$ sensor 13 is carried out at every relatively small time period, such as 4 ms, and the second air-fuel ratio feedback control by the downstream-side $O_2$ sensor 15 is carried out at every relatively large time period, such as 1 s. This is because the upstream-side $O_2$ sensor 13 has good response characteristics when compared with the downstream-side $O_2$ sensor 15.

Further, the present invention can be applied to a double $O_2$ sensor system in which other air-fuel ratio feedback control parameters, such as the integration amounts KIR and KIL, the delay time periods TDR1 and TDL1, or the reference voltage $V_{R1}$, are variable.

Still further, a Karman vortex sensor, a heat-wire type flow sensor, and the like can be used instead of the airflow meter.

Although in the above-mentioned embodiments, a fuel injection amount is calculated on the basis of the intake air amount and the engine speed, it can be also calculated on the basis of the intake air pressure and the engine speed, or the throttle opening and the engine speed.

Further, the present invention can be also applied to a carburetor type internal combustion engine in which the air-fuel ratio is controlled by an electric air control value (EACV) for adjusting the intake air amount; by an electric bleed air control valve for adjusting the air bleed amount supplied to a main passage and a slow passage; or by adjusting the secondary air amount introduced into the exhaust system. In this case, the base fuel injection amount corresponding to TAUP at step 601 of FIG. 6 or at step 1001 or FIG. 10 is determined by the carburetor itself, i.e., the intake air negative pressure and the engine speed, and the air amount corresponding to TAU at step 603 of FIG. 6 or at step 1003 of FIG. 10.

Further, a CO sensor, a lean-mixture sensor or the like can be also used instead of the $O_2$ sensor.

As explained above, according to the present invention, when the upstream-side air-fuel ratio sensor or the fuel injection valves become in an abnormal state or in a deterioration state in which compensation of the exhaust emission characteristics is impossible, such a state can be detected.

We claim:

1. A method for controlling an air-fuel ratio in an internal combustion engine having a catalyst converter for removing pollutants in the exhaust gas thereof, and upstream-side and downstream-side air-fuel ratio sensors disposed upstream and downstream, respectively, of said catalyst converter, for detecting a concentration of a specific component in the exhaust gas, comprising the steps of:

adjusting an actual air-fuel ratio in accordance with the outputs of said upstream-side and downstream-side air-fuel ratio sensors;

determining whether said upstream-side air-fuel ratio sensor is activated;

determining whether said upstream-side air-fuel ratio sensor is in an abnormal state when said upstream-side air-fuel ratio sensor is activated; and prohibiting the adjustment of said actual air-fuel ratio in accordance with the output of said downstream-side air-fuel ratio sensor when said upstream-side air-fuel ratio sensor is in an abnormal state and carrying out the adjustment of said actual air-fuel ratio in accordance with the output of said upstream-side air-fuel ratio sensor.

2. A method as set forth in claim 1, wherein said abnormal state is dependent upon the state of a fuel injector mounted on said engine.

3. A method as set forth in claim 1, wherein said abnormal state determining step comprises the steps of:

determining whether or not said upstream-side air-fuel ratio sensor is in a non-activation state;

calculating a duration of a period for which said upstream-side air-fuel ratio is in a non-activation state; and determining whether or not said duration of said period is longer than a predetermined period;

thereby determining that said upstream-side air-fuel ratio is in an abnormal state when said duration of said period is longer than said predetermined period.

4. A method as set forth in claim 3, wherein said non-activation determining step comprises a step of determining whether or not the output of said upstream-side air-fuel ratio sensor is changed between the lean side and the rich side.

5. A method as set forth in claim 1, wherein said actual air-fuel ratio adjusting step comprises the steps of:

calculating a first air-fuel ratio correction amount in accordance with the output of said upstream-side air-fuel ratio sensor; and calculating a second air-fuel ratio correction amount in accordance with the output of said downstream-side air-fuel ratio sensor; and adjusting said actual air-fuel ratio in accordance with said first and second air-fuel ratio correction amounts.

6. A method as set forth in claim 1, wherein said actual air-fuel ratio adjusting step comprises the steps of:

calculating an air-fuel ratio correction amount in accordance with the output of said upstream-side air-fuel ratio sensor; and calculating an air-fuel ratio feedback control parameter in accordance with the output of said downstream-side air-fuel ratio sensor; and adjusting said actual air-fuel ratio in accordance with said air-fuel ratio correction amount and said air-fuel ratio feedback control parameter.

7. A method as set forth in claim 6, wherein said air-fuel ratio feedback control parameter is defined by a lean skip amount by which said air-fuel ratio correction amount is skipped down when the output of said upstream-side air-fuel ratio sensor is switched from the lean side to the rich side and a rich skip amount by which said air-fuel ratio correction amount is skipped up when the output of said downstream-side air-fuel ratio sensor is switched from the rich side to the lean side.

8. A method as set forth in claim 6, wherein said air-fuel ratio feedback control parameter is defined by a lean integration amount by which said air-fuel ratio correction amount is gradually decreased when the output of said upstream-side air-fuel ratio sensor is on the rich side and a rich integration amount by which said air-fuel ratio correction amount is gradually increased when the output of said upstream-side air-fuel ratio sensor is on the lean side.

9. A method as set forth in claim 6, wherein said air-fuel ratio feedback control parameter is determined by a rich delay time period for delaying the output of said upstream-side air-fuel ratio sensor switched from the lean side to the rich side and a lean delay time period for delaying the output of said upstream-side air-fuel ratio sensor switched from the rich side to the lean side.

10. A method as set forth in claim 6, wherein said air-fuel ratio feedback control parameter is determined by a reference voltage with which the output of said upstream-side air-fuel ratio sensor is compared, thereby determining whether the air-fuel ratio is on the rich side or on the lean side.

11. An apparatus for controlling an air-fuel ratio in an internal combustion engine having a catalyst converter for removing pollutants in the exhaust gas thereof, and upstream-side and downstream-side air-fuel ratio sensors disposed upstream and downstream, respectively, of said catalyst converter, for detecting a concentration of a specific component in the exhaust gas, comprising:

means for adjusting an actual air-fuel ratio in accordance with the outputs of said upstream-side and downstream-side air-fuel ratio sensors;

means for determining whether said upstream-side air-fuel ratio sensor is activated;

means for determining whether said upstream-side air-fuel ratio sensor is in an abnormal state when said upstream-side air-fuel ratio sensor is activated; and means for prohibiting the adjustment of said actual air-fuel ratio in accordance with the output of said downstream-side air-fuel ratio sensor when said upstream-side air-fuel ratio sensor is in an abnormal state and carrying out adjustment of said actual air-fuel ratio in accordance with the output of said upstream-side air-fuel ratio sensor.

12. The apparatus as set forth in claim 11, wherein said abnormal state is dependent upon the state of a fuel injector mounted on said engine.

13. The apparatus as set forth in claim 11, wherein said abnormal state determining means comprises:

means for determining whether or not said upstream-side air-fuel ratio sensor is in a non-activation state;

means for calculating a duration of a period for which said upstream-side air-fuel ratio is in a non-activation state; and means for determining whether or not said duration of said period is longer than a predetermined period, thereby determining that said upstream-side air-fuel ratio is in an abnormal state when said duration of said period is longer than said predetermined period.

14. The apparatus as set forth in claim 13, wherein said non-activation determining means comprises means for determining whether or not the output of said upstream-side air-fuel ratio sensor is changed between the lean side and the rich side.

15. The apparatus as set forth in claim 11, wherein said actual air-fuel ratio adjusting means comprises:

means for calculating a first air-fuel ratio correction amount in accordance with the output of said upstream-side air-fuel ratio sensor;

means for calculating a second air-fuel ratio correction amount in accordance with the output of said downstream-side air-fuel ratio sensor; and means for adjusting said actual air-fuel ratio in accordance with said first and second air-fuel ratio correction amounts.

16. An apparatus as set forth in claim 11, wherein said actual air-fuel ratio adjusting means comprises:

means for calculating an air-fuel ratio correction amount in accordance with the output of said upstream-side air-fuel ratio sensor; and means for calculating an air-fuel ratio feedback control parameter in accordance with the output of said downstream-side air-fuel ratio sensor; and means for adjusting said actual air-fuel ratio in accordance with said air-fuel ratio correction amount and said air-fuel ratio feedback control parameter.

17. An apparatus as set forth in claim 16, wherein said air-fuel ratio feedback control parameter is defined by a lean skip amount by which said air-fuel ratio correction amount is skipped down when the output of said upstream-side air-fuel ratio sensor is switched from the lean side to the rich side and a rich skip amount by which said air-fuel ratio correction amount is skipped up when the output of said downstream-side air-fuel ratio sensor is switched from the rich side to the lean side.

18. An apparatus as set forth in claim 16, wherein said air-fuel ratio feedback control parameter is defined by a lean integration amount by which said air-fuel ratio correction amount is gradually decreased when the output of said upstream-side air-fuel ratio sensor is on the rich side and a rich integration amount by which said air-fuel correction amount is gradually increased when the output of said upstream-side air-fuel ratio sensor is on the lean side.

19. The apparatus as set forth in claim 16, wherein said air-fuel ratio feedback control parameter is determined by a rich delay time period for delaying the output of said upstream-side air-fuel ratio sensor switched from the lean side to the rich side and a lean delay time period for delaying the output of said upstream-side air-fuel ratio sensor switched from the rich side to the lean side.

20. The apparatus as set forth in claim 16, wherein said air-fuel ratio feedback control parameter is determined by a reference voltage with which the output of said upstream-side air-fuel ratio sensor is compared, thereby determining whether the air-fuel ratio is on the rich side or on the lean side.

* * * * *